US008074459B2

(12) United States Patent
Murakami et al.

(10) Patent No.: US 8,074,459 B2
(45) Date of Patent: Dec. 13, 2011

(54) HEAT PUMP SYSTEM HAVING AUXILIARY WATER HEATING AND HEAT EXCHANGER BYPASS

(75) Inventors: Toshio Murakami, Sao Paulo (BR); Carlos A. Tesche, Canoas (BR); Roberto G. Fernandez, Buenos Aires (AR)

(73) Assignee: Carrier Corporation, Farmington, CT (US)

( * ) Notice: Subject to any disclaimer, the term of this patent is extended or adjusted under 35 U.S.C. 154(b) by 667 days.

(21) Appl. No.: 11/630,080

(22) PCT Filed: Apr. 20, 2006

(86) PCT No.: PCT/BR2006/000075

§ 371 (c)(1),
(2), (4) Date: Oct. 7, 2008

(87) PCT Pub. No.: WO2007/121540

PCT Pub. Date: Nov. 1, 2007

(65) Prior Publication Data

US 2009/0049857 A1 Feb. 26, 2009

(51) Int. Cl.
*F25B 29/00* (2006.01)

(52) U.S. Cl. ..... 62/159; 62/324.1

(58) Field of Classification Search ..... 62/324.1, 62/159, 160, 238.7, 196.1, 196.3, 196.4, 62/117; 165/80.5, 104.22
See application file for complete search history.

(56) References Cited

U.S. PATENT DOCUMENTS 3,177,674 A 4/1965 Spofford
3,188,829 A 6/1965 Siewert et al.
3,301,002 A 1/1967 McGrath
4,098,092 A 7/1978 Singh
4,134,274 A 1/1979 Johnsen
4,238,933 A 12/1980 Coombs
4,249,390 A 2/1981 Jones
4,299,098 A 11/1981 Derosier
4,399,664 A 8/1983 Derosier
4,409,796 A 10/1983 Fisher
4,492,092 A 1/1985 Smorol et al.
4,493,193 A 1/1985 Fisher
4,528,822 A 7/1985 Glamm
4,598,557 A 7/1986 Robinson et al.
4,646,537 A 3/1987 Crawford
4,766,734 A 8/1988 Dudley
4,940,079 A 7/1990 Best et al.
5,184,472 A 2/1993 Guilbault et al.
5,211,029 A 5/1993 Uselton et al.
5,269,153 A 12/1993 Cawley
5,465,588 A 11/1995 McCahill et al.
5,467,812 A 11/1995 Dean et al.
5,473,906 A * 12/1995 Hara et al. ..... 62/160
5,495,723 A 3/1996 MacDonald et al.
5,653,120 A 8/1997 Meyer
5,669,224 A * 9/1997 Lenarduzzi ..... 62/160
(Continued)

*Primary Examiner* — Mohammad Ali
(74) *Attorney, Agent, or Firm* — Cantor Colburn LLP

(57) ABSTRACT

A heat pump system (10) includes a compressor (20), a reversing valve (30), an outdoor heat exchanger (40) and an indoor heat exchanger (50) coupled via refrigerant lines (35, 45, 55) in a conventional refrigeration circuit, a refrigerant to liquid heat exchanger (60), a refrigerant to liquid heat exchanger bypass valve (130), an outdoor heat exchanger bypass valve (230), and an indoor heat exchanger bypass valve (330). A controller (100) is provided to selectively control the respective positioning of the valves (30, 130, 230 and 330) between their respective open and closed positions so as to selectively configure the refrigerant circuit for operation in one of an air cooling only mode, an air cooling with liquid heating mode, an air heating only mode, an air heating with liquid heating mode, and a liquid heating only mode.

10 Claims, 15 Drawing Sheets

U.S. PATENT DOCUMENTS 5,678,626 A * 10/1997 Gilles ..... 165/62
5,755,104 A * 5/1998 Rafalovich et al. ..... 62/81
5,802,864 A 9/1998 Yarbrough et al.
5,901,563 A 5/1999 Yarbrough et al.
6,038,873 A * 3/2000 Koo ..... 62/196.4
6,253,564 B1 7/2001 Yarbrough et al.
6,286,322 B1 9/2001 Vogel et al.
6,604,376 B1 * 8/2003 Demarco et al. ..... 62/324.1
6,615,602 B2 9/2003 Wilkinson
6,945,066 B2 * 9/2005 Hiwata et al. ..... 62/324.6
2004/0074254 A1 * 4/2004 Hiwata et al. ..... 62/402
2004/0074256 A1 * 4/2004 Hiwata et al. ..... 62/527

* cited by examiner

HEAT PUMP SYSTEM HAVING AUXILIARY WATER HEATING AND HEAT EXCHANGER BYPASS

CROSS-REFERENCE TO RELATED APPLICATIONS

This application relates to the following related applications: International Patent Application No. PCT/BR05/00097, filed 3 Jun. 2005 and entitled "HEAT PUMP SYSTEM WITH AUXILIARY WATER HEATING"; International Patent Application No. PCT/BR05/00098, filed 3 Jun. 2005 and entitled "REFRIGERANT CHARGE CONTROL IN A HEAT PUMP SYSTEM WITH WATER HEATING"; and International Patent Application No. PCT/BR05/00099, filed 3 Jun. 2005 and entitled "REFRIGERANT SYSTEM WITH WATER HEATING", each of which applications is, together with this application, subject to assignment to a common assignee.

TECHNICAL FIELD

This invention relates generally to heat pump systems and, more particularly, to heat pump systems including auxiliary liquid heating, including for example heating water for swimming pools, household water systems and the like.

BACKGROUND ART

Reversible heat pumps are well known in the art and commonly used for cooling and heating a climate controlled comfort zone with a residence or a building. A conventional heat pump includes a compressor, a suction accumulator, a reversing valve, an outdoor heat exchanger with an associated fan, an indoor heat exchanger with an associated fan, an expansion valve operatively associated with the outdoor heat exchanger and a second expansion valve operatively associated with the indoor heat exchanger. The aforementioned components are typically arranged in a closed refrigerant circuit pump system employing the well known refrigerant vapor compression cycle. When operating in the cooling mode, excess heat absorbed by the refrigerant in passing through the indoor heat exchanger is rejected to the environment as the refrigerant passes through the outdoor heat exchanger.

It is well known in the art that an additional refrigerant-to-water heat exchanger may be added to a heat pump system to absorb this excess heat for the purpose of heating water, rather than simply rejecting the excess heat to the environment. Further, heat pumps often have non-utilized heating capacity when operating in the heating mode for heating the climate controlled zone. For example, each of U.S. Pat. Nos. 3,188,829; 4,098,092; 4,492,092 and 5,184,472 discloses a heat pump system including an auxiliary hot water heat exchanger. However, these systems do not include any device for controlling the refrigerant charge within the refrigerant circuit. Therefore, while functional, these systems would not be optimally efficient in all modes of operation.

In heat pump systems, the outdoor heat exchanger and the indoor heat exchanger each operate as evaporator, condenser or subcooler, depending on the mode and point of operation. As such, condensing may occur in either heat exchangers, and the suction line may be filled with refrigerant in a gaseous or liquid state. As a consequence, the amount of system refrigerant charge required in each mode of operation in order to ensure operation within an acceptable efficiency envelope will be different for each mode.

U.S. Pat. No. 4,528,822 discloses a heat pump system including an additional refrigerant-to-liquid heat exchanger for heating liquid utilizing the heat that would otherwise be rejected to the environment. The system is operable in four independent modes of operation: space heating, space cooling, liquid heating and simultaneous space cooling with liquid heating. In the liquid heating only mode, the indoor heat exchanger fan is turned off, while in the space cooling and liquid heating mode, the outdoor heat exchanger fan is turned off. A refrigerant charge reservoir is provided into which liquid refrigerant drains by gravity from the refrigerant to liquid heat exchanger during the liquid heating only mode and the simultaneous space cooling and liquid heating mode. However, no control procedure is disclosed for actively controlling refrigerant charge in the refrigerant circuit in all modes of operation. Further, no simultaneous space heating and liquid heating mode is disclosed.

Accordingly, it is desirable that heat pump system with liquid heating capability operate effectively in an air cooling only mode, an air cooling and liquid heating mode, an air heating only mode, an air heating and liquid heating mode, and a liquid heating only mode.

SUMMARY OF THE INVENTION

In one aspect, it is an object of the invention to provide a heat pump system having air cooling, air heating, and liquid heating capability.

In one aspect, it is an object of the invention to provide a heat pump system having a refrigerant to liquid heat exchanger in addition to conventional outdoor and indoor heat exchangers, with the capability of selectively bypassing any of the aforementioned heat exchangers.

In one embodiment of the invention, a heat pump system includes a refrigerant compressor, an indoor heat exchanger and an outdoor heat exchanger arranged in a refrigerant circuit; a selectively positionable four-port reversing valve having a first position for configuring the refrigerant circuit in an air cooling mode and a second position for configuring the refrigerant circuit in an air heating mode; a refrigerant to liquid heat exchanger bypass valve; an outdoor heat exchanger bypass valve; and an indoor heat exchanger bypass valve. The refrigerant circuit has a first refrigerant line establishing a flow path between the discharge port of the compressor and the first port of the reversing valve, a second refrigerant line establishing a flow path between the second port of the reversing valve and the third port of the reversing valve, and a third refrigerant line establishing a flow path between the fourth port of the reversing valve and the suction port of the compressor. The outdoor heat exchanger is disposed in operative association with the second refrigerant line and is adapted for passing refrigerant passing through the second refrigerant line in heat exchange relationship with ambient air. The indoor heat exchanger is disposed in operative association with the second refrigerant line and is adapted for passing refrigerant passing through the second refrigerant line in heat exchange relationship with the air from the comfort zone. The refrigerant to liquid heat exchanger is disposed in operative association with the first refrigerant line and is adapted for passing refrigerant passing through the first refrigerant line in heat exchange relationship with a liquid.

A selectively positionable refrigerant to liquid heat exchanger bypass valve is provided in operative association with the first refrigerant line. The refrigerant to liquid heat exchanger bypass valve has a first position wherein refrigerant passing through the first refrigerant line from the compressor is directed to the first port of the reversing valve without passing through the refrigerant to liquid heat exchanger and a second position wherein refrigerant passing through the first refrigerant line from the compressor is directed through the refrigerant to liquid heat exchanger prior to passing to the first port of the reversing valve.

An outdoor heat exchanger bypass valve is provided in operative association with the second refrigerant line at a location upstream of the outdoor heat exchanger with respect to refrigerant flow when the heat pump system is operating in the air cooling only mode. The outdoor heat exchanger bypass valve has a first position wherein refrigerant passing through the second refrigerant line from the second port of the reversing valve is directed to pass through the outdoor heat exchanger and a second position wherein refrigerant passing through the second refrigerant line from the second port of the reversing valve is directed to bypass the outdoor heat exchanger.

An indoor heat exchanger bypass valve is provided in operative association with the second refrigerant line at a location upstream of the indoor heat exchanger with respect to refrigerant flow when the heat pump system is operating in the air heating only mode, the indoor heat exchanger bypass valve having a first position wherein refrigerant passing through the second refrigerant line from the third port of the reversing valve is directed to pass through the indoor heat exchanger and a second position wherein refrigerant passing through the second refrigerant line from the third port of the reversing valve is directed to bypass the indoor heat exchanger.

In an embodiment, the refrigerant circuit may include a fourth refrigerant line connecting a port of the outdoor heat exchanger bypass valve with the second refrigerant line at a location intermediate the outdoor heat exchanger and the indoor heat exchanger, and a fifth refrigerant line connecting a port of the indoor heat exchanger bypass valve with the second refrigerant line at a location intermediate the outdoor heat exchanger and the indoor heat exchanger. A controller is provided in operative association with the reversing valve, the refrigerant to liquid heat exchanger bypass valve, the outdoor heat exchanger bypass valve and the indoor heat exchanger bypass valve, the controller operative to selectively control the respective positioning of the aforementioned valves between their respective first and second positions so as to selectively configure the refrigerant circuit for operation in one of an air cooling only mode, an air cooling with liquid heating mode, an air heating only mode, an air heating with liquid heating mode, and a liquid heating only mode.

In an embodiment, a refrigerant reservoir is provided having an inlet coupled through a fourth refrigerant line in fluid flow communication to the second refrigerant line at a location intermediate the outdoor heat exchanger and the indoor heat exchanger and an outlet coupled through a sixth refrigerant line in fluid flow communication to the third refrigerant line. A first flow control valve having an open position and a closed position may be provided for controlling the flow of refrigerant from the second refrigerant line to the inlet of the refrigerant reservoir and a second flow control valve having an open position and a closed position may be provided for controlling the flow refrigerant between the outlet of refrigerant reservoir and the third refrigerant line. The controller may be operative to selectively control the respective positioning of the first and second flow control valves between their respective open and closed positions so as to selectively control the refrigerant charge within the refrigerant circuit. The first and second flow control valves may also have at least one partially open position and may comprise pulse width modulated solenoid valves. The controller may be further operative to selectively modulate the respective positioning of the flow control valves between their open, partially open and closed positions.

In a further embodiment, a first expansion valve may be provided in the second refrigerant line in operative association with the indoor heat exchanger and a second expansion valve may be provided in the second refrigerant line in operative association with the outdoor heat exchanger. A first expansion valve bypass line operatively associated with the second refrigerant line provides for bypassing refrigerant passing through the second refrigerant line in a direction from the outdoor heat exchanger to the indoor heat exchanger around the first expansion valve and through said second expansion valve. A second expansion valve bypass line operatively associated with the second refrigerant line provides for bypassing refrigerant passing through the second refrigerant line in a direction from the indoor heat exchanger to the outdoor heat exchanger around the second expansion valve and through the first expansion valve.

BRIEF DESCRIPTION OF THE DRAWINGS

For a further understanding of these and objects of the invention, reference will be made to the following detailed description of the invention which is to be read in connection with the accompanying drawing, where.

DETAILED DESCRIPTION OF THE INVENTION

Figure 1:
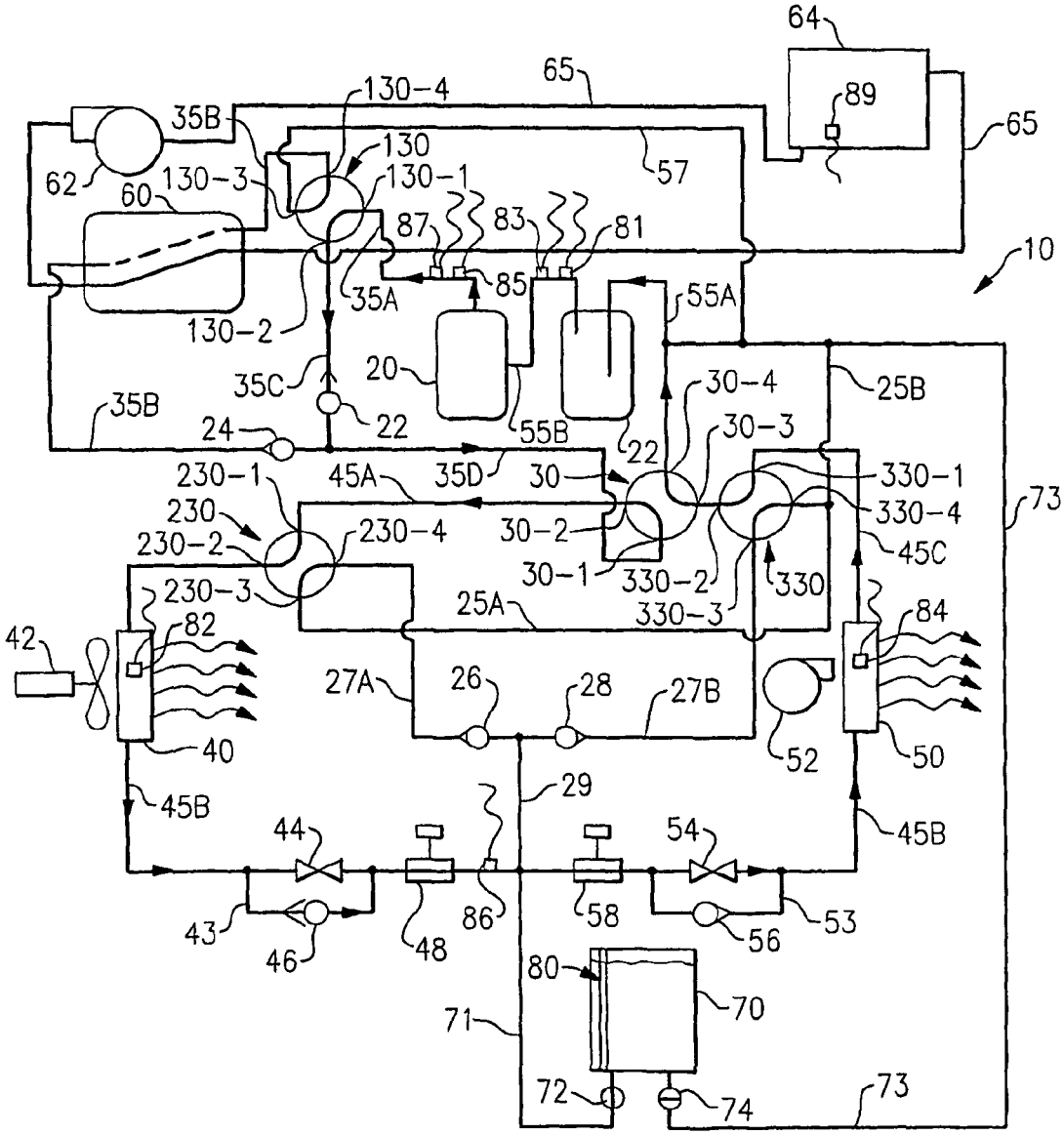
FIG. 1 is a schematic diagram illustrating a first embodiment of the heat pump system of the invention illustrating operation in an indoor air cooling only mode.

The refrigerant heat pump system 10, depicted in a first embodiment in FIGS. 1, 3, 5, 7 and 9 and a second embodiment in FIGS. 2, 4, 6, 8 and 10, provides not only either heating or cooling air to a comfort region, for example an indoor zone located on the inside of a building (not shown), but also auxiliary water heating when desired. The system includes a compressor 20, a suction accumulator 22, a reversing valve 30, an outdoor heat exchanger 40 and associated fan 42 located on the outside of the building in heat transfer relation with the surrounding ambient, an indoor heat exchanger 50 and associated fan 52 situated in the comfort zone, a first expansion valve 44 operatively associated with the outdoor heat exchanger 40 and a second expansion valve 54 operatively associated with the indoor heat exchanger 50, a refrigerant-to-water heat exchanger 60, a heat exchanger bypass valve 130, a first bypass/bleed valve 230 and a second bypass/bleed valve 330. A refrigerant circuit including refrigerant lines 35, 45 and 55 provides a closed loop refrigerant flow path coupling these components in a conventional manner for a heat pump system employing a conventional refrigerant vapor compression cycle. Refrigerant may be directed through the refrigerant-to-water heat exchanger 60 wherein the refrigerant passes in heat exchange relationship with water to be heated. The water to be heated is pumped by a circulating pump 62 via water circulation line 65 from a water reservoir 64, for example a hot water storage tank or a swimming pool, through the heat exchanger 60 and back to the reservoir 64. The refrigerant-to-water heat exchanger 60 is operatively associated with section 35B of the refrigerant line 35 whereby refrigerant flowing through the refrigerant line 35 passes in heat exchange relationship with water passing through water circulation line 65.

The compressor 20, which may comprise a rotary compressor, a scroll compressor, a reciprocating compressor, a screw compressor or any other type of compressor, has a suction inlet for receiving refrigerant from the suction accumulator 22 and an outlet for discharging compressed refrigerant. The reversing valve 30 may comprise a selectively positionable, two-position, four-port valve having a first port 30-1, a second port 30-2, a third port 30-3 and a fourth port 30-4. The reversing valve 30 is positionable in a first position for coupling the first port and the second port in fluid flow communication and for simultaneously coupling the third port and the fourth port in fluid flow communication. The reversing valve 30 is positionable in a second position for coupling the first port and the third port in fluid flow communication and for simultaneously coupling the second port and the fourth port in fluid flow communication. Advantageously, the respective port-to-port couplings established in the first and second positions are accomplished internally within the valve 30. The outlet 28 of the compressor 20 is connected in fluid flow communication via refrigerant line 35 to the first port 30-1 of the reversing valve 30. The second port 30-2 of the reversing valve 30 is coupled externally of the valve in refrigerant flow communication to the third port 30-3 of the reversing valve 30 via refrigerant line 45. The fourth port 30-4 of the reversing valve 30 is coupled in refrigerant flow communication to the suction inlet 26 of the compressor 20 via refrigerant line 55. When the heat pump system is operated in an air cooling mode, with or without water heating, the reversing valve 30 is positioned in the first position as depicted in FIGS. 1, 2, 3 and 4. When the heat pump system is operated in an air heating mode, with or without water heating, the reversing valve 30 is positioned in the second position as depicted in FIGS. 5, 6, 7, and 8. When the heat pump system is operated in a water heating only mode, the reversing valve 30 is positioned in the second position as depicted in FIGS. 9 and 10.

The outdoor heat exchanger 40 and the indoor heat exchanger 50 are operatively disposed in the refrigerant line 45. The outdoor heat exchanger 50 is connected in fluid flow communication via section 45A of the refrigerant line 45 with the second port 30-2 of the reversing valve 30. The indoor heat exchanger 50 is connected in fluid flow communication to the third port 30-3 of the reversing valve 30 via section 45C of the refrigerant line 45. Section 45B of the refrigerant line 45 couples the outdoor heat exchanger 40 and the indoor heat exchanger 50 in refrigerant flow communication. A suction accumulator 22 may be disposed in refrigerant line 55 on the suction side of the compressor 20, having its inlet connected in refrigerant flow communication to the fourth port 30-4 of the reserving valve 30 via section 55A of refrigerant line 55 and having its outlet connected in refrigerant flow communication to the suction inlet of the compressor 20 via section 55B of refrigerant line 55. Therefore, refrigerant lines 35, 45 and 55 together couple the compressor 20, the outdoor heat exchanger 40 and the indoor heat exchanger 50 in refrigerant flow communication, thereby creating a circuit for refrigerant flow circulation through the heat pump system 10.

First and second expansion valves 44 and 54 are disposed in section 45B of the refrigerant line 45. In the embodiments depicted in the drawings, the first expansion valve 44 is operatively associated with the outdoor heat exchanger 40 and the second expansion valve 54 is operatively associated with the indoor heat exchanger 50. Each of the expansion valves 44 and 54 is provided with a bypass line equipped with a check valve permitting flow in only one direction. Check valve 46 in bypass line 43 associated with the outdoor heat exchanger expansion valve 44 passes refrigerant flowing from the outdoor heat exchanger 40 to the indoor heat exchanger 50, thereby bypassing the outdoor heat exchanger expansion valve 44 and passing the refrigerant to the indoor heat exchanger expansion valve 54. Conversely, check valve 56 in bypass line 53 associated with the indoor heat exchanger expansion valve 54 passes refrigerant flowing from the indoor heat exchanger 50 to the outdoor heat exchanger 40, thereby bypassing the indoor heat exchanger expansion valve 54 and passing the refrigerant to the outdoor heat exchanger expansion valve 44.

The refrigerant-to-water heat exchanger bypass valve 130 comprises a selectively positionable, two-position, four-port valve having a first port 130-1, a second port 130-2, a third port 130-3 and a fourth port 130-4. The valve 130 is positionable in a first position for coupling the first port 130-1 and the second port 130-2 in fluid flow communication and for simultaneously coupling the third port 130-3 and the fourth port 130-4 in fluid flow communication. The valve 130 is positionable in a second position for coupling the first port 130-1 and the fourth port 130-4 in fluid flow communication and for simultaneously coupling the second port 130-2 and the third port 130-3 in fluid flow communication. Advantageously, the respective port-to-port couplings established in the first and second positions are accomplished internally within the valve 130. The valve 130 is disposed in the refrigerant circuit with the first port 130-1 in fluid flow communication with the outlet of the compressor 20 through upstream section 35A of refrigerant line 35, with the second port 130-2 in fluid flow communication with the downstream section 35B of refrigerant line 35 via refrigerant line 35C, with the third port 130-3 in fluid flow communication with the refrigerant line 57, and with the fourth port 130-4 in fluid flow communication with the intermediate section 35B of refrigerant line 35. A flow check valve 22 is disposed in the refrigerant line 35C and flow check valve 24 is disposed in the intermediate section 35B of the refrigerant line 35. The check valve 22 permits refrigerant flow from the compressor 20 via the bypass valve 130 through refrigerant line 35C to the downstream section 35D of refrigerant line 35, but blocks flow through refrigerant line 35C in the reverse direction. The check valve 24 permits refrigerant flow from the compressor 20 via port 130-4 of the bypass valve 130 through section 35B of refrigerant line 35 to the downstream section 35D of refrigerant line 35, but blocks flow through section 35B of refrigerant line 35 in the reverse direction.

The first bypass/bleed valve 230 comprises a selectively positionable, two-position, four-port valve having a first port 230-1, a second port 230-2, a third port 230-3 and a fourth port 230-4. The first bypass/bleed valve 230 is positionable in a first position for coupling the first port 230-1 and the second port 230-2 in fluid flow communication and for simultaneously coupling the third port 230-3 and the fourth port 230-4 in fluid flow communication. The first bypass/bleed valve 230 is positionable in a second position for coupling the first port 230-1 and the fourth port 230-4 in fluid flow communication and for simultaneously coupling the second port 130-2 and the third port 230-3 in fluid flow communication. Advantageously, the respective port-to-port couplings established in the first and second positions are accomplished internally within the valve 230. The first bypass/bleed valve 230 is disposed in the refrigerant circuit in section 45A of refrigerant line 45 with its first port 230-1 in fluid flow communication via refrigerant line 45A with the second port 30-2 of the reversing valve 30, and with its second port 230-2 in fluid flow communication with the section 45B of refrigerant line 45.

The second bypass/bleed valve 330 comprises a selectively positionable, two-position, four-port valve having a first port 330-1, a second port 330-2, a third port 330-3 and a fourth port 330-4. The second bypass/bleed valve 330 is positionable in a first position for coupling the first port 330-1 and the second port 330-2 in fluid flow communication and for simultaneously coupling the third port 330-3 and the fourth port 330-4 in fluid flow communication. The second bypass/bleed valve 330 is positionable in a second position for coupling the first port 330-1 and the fourth port 330-4 in fluid flow communication and for simultaneously coupling the second port 330-2 and the third port 330-3 in fluid flow communication. Advantageously, the respective port-to-port couplings established in the first and second positions are accomplished internally within the valve 330. The second bypass/bleed valve 330 is disposed in the refrigerant circuit in section 45C of refrigerant line 45 with its first port 330-1 in fluid flow communication with refrigerant line 45C, and with its second port 330-2 in fluid flow communication with the third port 30-3 of the reversing valve 30.

The first bypass/bleed valve 230 and the second bypass valve 330 are connected in fluid flow communication through a bypass/bleed circuit comprising refrigerant lines 25, 27 and 29. The third port 230-3 of the first bypass/bleed valve 230 is connected in flow communication with the fourth port 330-4 of the second bypass/bleed valve 330 via section 25A of refrigerant line 25. The fourth port 230-4 of the first bypass/bleed valve 230 is connected in flow communication with the third port 330-3 of the second bypass/bleed valve 330 via refrigerant line 27. A flow check valve 26 and a flow check valve 28 are disposed in refrigerant line 27. The refrigerant line 29 provides fluid flow communication between refrigerant line 27 and section 45B of the refrigerant line 45, intersecting in fluid flow communication with refrigerant line 27 at a location intermediate the flow check valves 26 and 28 and intersecting in fluid flow communication with refrigerant line 45 at a location intermediate the flow control valves 48 and 58. The check valve 26 permits refrigerant flow through section 27A of refrigerant line 27 to refrigerant line 29, but blocks flow through section 27A of refrigerant line 27 in the reverse direction. Similarly, the check valve 28 permits refrigerant flow through section 27B of refrigerant line 27 to refrigerant line 29, but blocks flow through section 27B of refrigerant line 27 in the reverse direction. Additionally, a first flow control valve 48 is disposed in section 45B of refrigerant line 45 between the expansion valve 44 and the connection of refrigerant line 29 into line 45, and a second flow control valve 58 is disposed in section 45B of refrigerant line 45 between the expansion valve 54 and the connection of refrigerant line 29 into line 45. Advantageously, both of the flow control valves 48 and 58 may be solenoid valves selectively positionable by a system controller (not shown) in either the open position or the closed position.

When the first bypass/bleed valve 230 is positioned in its first position, refrigerant flow passing through refrigerant line 45 passes through the outdoor heat exchanger 40. However, when the first bypass/bleed valve 230 is positioned in its second position, the flow control valve 48 is positioned in its closed position, whereby refrigerant flow passes through a bypass circuit formed by section 27A of the refrigerant line 27 and refrigerant line 29 thereby bypassing the outdoor heat exchanger 40. When the second bypass/bleed valve 330 is positioned in its first position, refrigerant flow passing through refrigerant line 45 passes through the indoor heat exchanger 50. However, when the second bypass/bleed valve 330 is positioned in its second position, the flow control valve 58 is positioned in its closed position, whereby, refrigerant flow passes through a bypass circuit formed by section 27B of the refrigerant line 27 and refrigerant line 29 thereby bypassing the indoor heat exchanger 50.

In the embodiment of the heat pump system 10 depicted in FIGS. 2, 4, 6, 8 and 10, the system includes, in addition to the previously mentioned components, a suction line bypass valve 90 having a first position and a second position, a bypass flow control valve 92, such as for example a solenoid valve, having a valve open state and a valve closed state, a bypass line 93, a bypass line 95 and a check valve 94. The suction line bypass valve 90, which advantageously may be a selectively positionable, two-position, four-port valve having a first port 90-1, a second port 90-2, a third port 90-3 and a fourth port 90-4, is disposed in line 45C of the refrigeration circuit intermediate the indoor heat exchanger 50 and the reversing valve 30. The first port 90-1 of the suction line bypass valve 90 is in flow communication with line 45C of the refrigerant circuit. The second port 90-2 of the suction line bypass valve 90 is connected externally in refrigerant flow communication with the first port 330-1 of the second bypass valve 330, whereby refrigerant line 45C will be in refrigerant flow communication with the third port 30-3 of the reversing valve 30 whenever the suction line bypass valve 90 is in its first position, as illustrated in FIGS. 2, 4, 6, 10A and 10B. Refrigerant line 93 extends in flow communication between refrigerant line 73 and the third port 90-3 of the suction line bypass valve 90. Refrigerant line 95 extends in flow communication between a fourth port 90-4 of the suction line bypass valve 90 and refrigerant line 45C, opening thereto at a location intermediate the indoor heat exchanger 50 and the bypass flow control valve 92, whereby lines 93 and 95 will be also connected in refrigerant flow communication whenever the suction line bleed flow valve 90 is in its first position.

The bypass flow control valve 92 is disposed in refrigerant line 45C and is operative to close the refrigerant line 45C to flow therethrough when in its valve closed state and to open the refrigerant line 45C to flow therethrough when in its valve open state. The check valve 94 is disposed in refrigerant line 95 so as to permit refrigerant to flow through refrigeration line 95 from the suction line bypass valve 90 into refrigerant line 45C, but to block refrigerant flow through the refrigeration line 95 from the refrigeration line 45C to the suction line bypass valve 90. Whenever the suction line bypass valve 90 is in its second position, refrigerant lines 45C and 93 will be coupled in refrigerant flow communication, and refrigerant line 95 will be coupled in refrigerant flow communication through the first port 330-1 of the bypass valve 330, as illustrated in FIG. 8. Because bypass line 95 is used to covey hot liquid refrigerant to the indoor air exchanger in the indoor air heating with water heating mode only, bypass line 95 is sized with a small diameter than section 45C of refrigerant line 45, whereby the volume of bypass line 95 will be substantially smaller than the volume of section 45C of refrigerant line 45, thus f reducing the refrigerant charge required to fill the refrigerant circuit in this mode. In the other modes of operation of the heat pump system, the bypass line check valve 92 is closed and the refrigerant line 95 is merely connected in refrigerant flow communication via refrigerant lines 93 and 55A to the suction accumulator whereby any refrigerant resident in line 95 is bled back to the suction accumulator 22 to return to the suction inlet of the compressor 20.

In the system of the invention, the heat pump functions not only either to heat or cool air to a comfort region, but also to heat water on demand. Therefore, the system must operate effectively in an air cooling only mode, an air cooling and water heating mode, an air heating only mode, an air heating and water heating mode, and a water heating only mode. As both the outdoor heat exchanger 40 and the indoor heat exchanger 50 operate as evaporator, condenser or subcooler, depending on the mode and point of operation, condensing may occur in one or two heat exchangers, and the suction line may be filled with refrigerant in a gaseous or liquid state. As a consequence, the amount of system refrigerant charge required in each mode in order to ensure operation within an acceptable efficiency envelope will be different for each mode. When water heating is not required, the amount of refrigerant charge required will also be affected by the amount of heat exchange due to the occurrence of thermosiphoning in the refrigerant-to-water heat exchanger 60.

Accordingly, the system 10 further includes a refrigerant storage reservoir 70, termed a charge tank, having an inlet connected in fluid flow communication with the refrigerant line 45 via refrigerant line 71 and an outlet connected in fluid flow communication with the refrigerant line 55 via refrigerant line 73, a first flow control valve 72 disposed in the refrigerant line 71, and a second flow control valve 74 disposed in the refrigerant line 73. Each of the first and second flow control valves 72 and 74 has an open position and a closed position so that flow therethrough may be selectively controlled whereby the refrigerant-charge within the refrigerant circuit may be actively controlled. Advantageously, each of the first and second flow control valves 72 and 74 may also have at least one partially open position and may be a pulse width modulated solenoid valve. Additionally, a liquid level meter 80, such as for example a transducer, may be disposed in the charge tank 70 for monitoring the refrigerant level within the charge tank.

Figure 9:
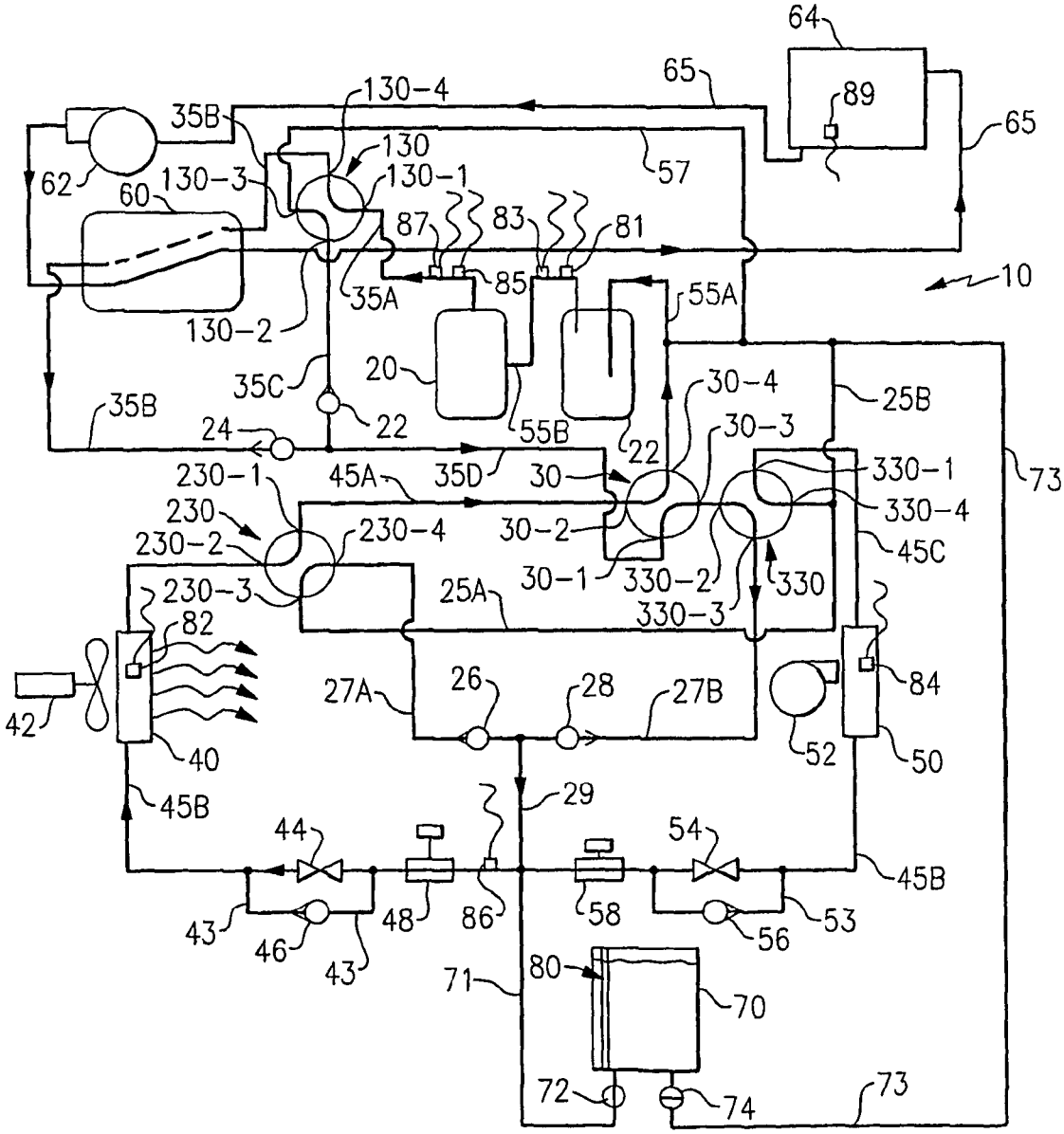
FIG. 9 is a schematic drawing illustrating a first embodiment of the heat pump system of the invention illustrating operation in a water heating only mode.
Figure 10A:
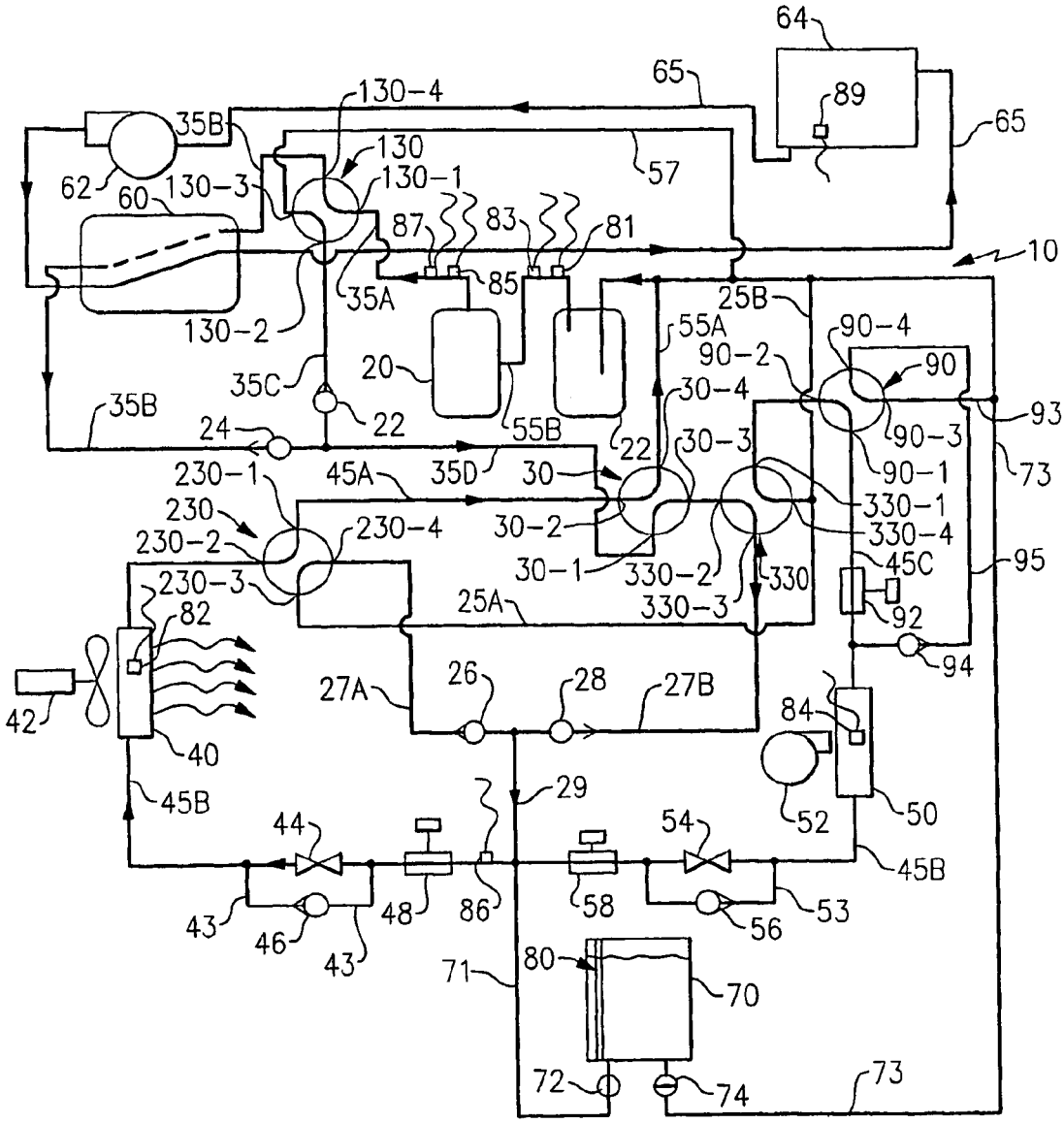
FIG. 10A is a schematic drawing illustrating a second embodiment of the heat pump system of the invention illustrating operation in a water heating only mode.
Figure 10B:
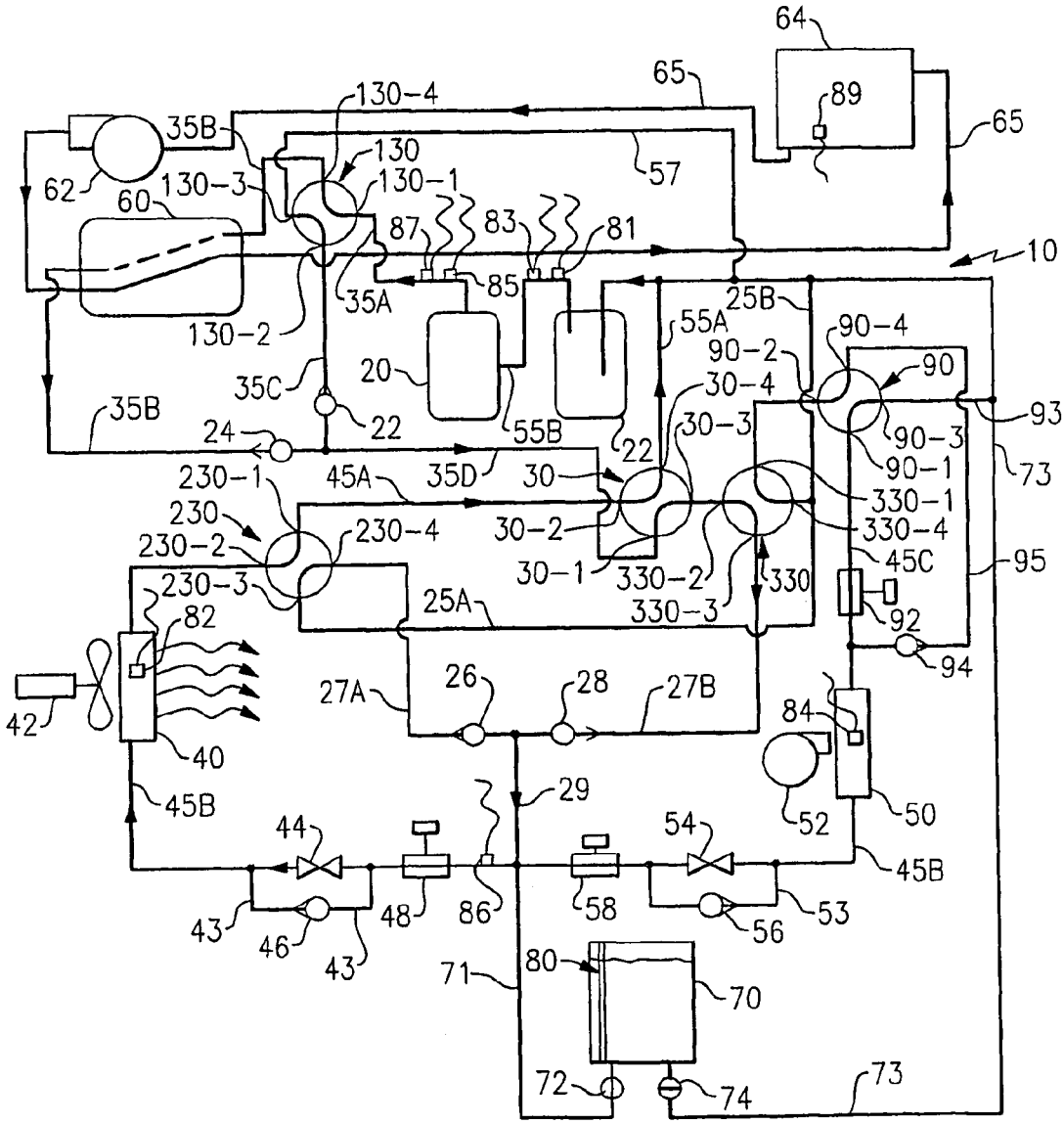
FIG. 10B is a schematic drawing illustrating a third embodiment of the heat pump system of the invention illustrating operation in a water heating only mode.
Figure 11:
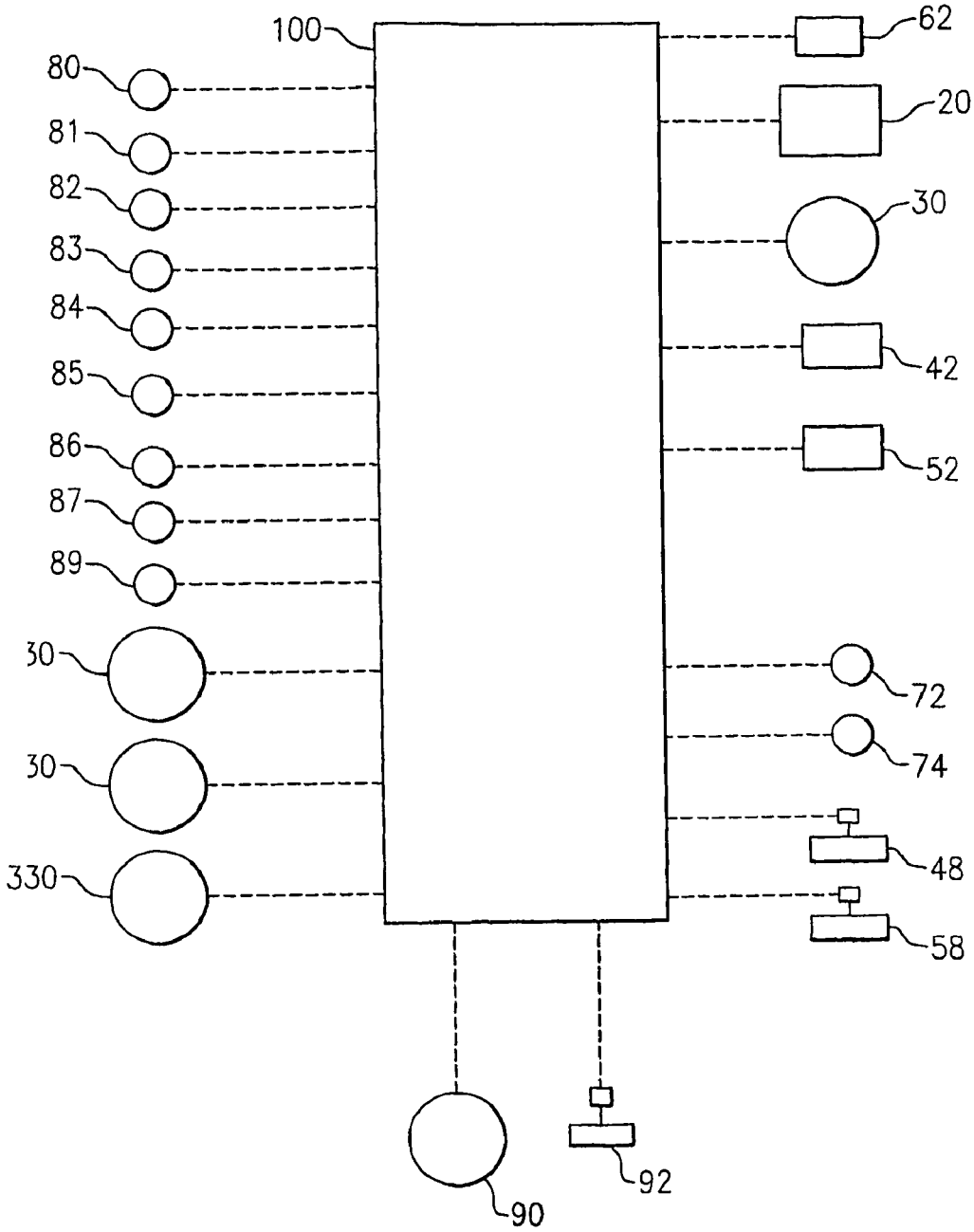
FIG. 11 is a schematic diagram illustrating an embodiment of a control system arrangement for the heat pump system of the invention.

Referring now to FIG. 11, a system controller 100, advantageously a microprocessor, controls the operation of the water pump 62, the compressor 20, the reversing valve 30, the heat exchanger bypass valve 130, the first bypass/bleed valve 230, the second bypass/bleed valve 330, and other heat pump components, such as the outdoor heat exchanger fan 42 and the indoor heat exchanger fan 52, in response to the cooling or heating demand of the comfort region in a conventional manner and/or the demand for water heating. In the embodiment depicted in FIGS. 6-10, the system controller also controls operation of the suction line bypass valve 90 and the bypass flow control valve 92. In addition, the system controller 100 controls the opening and closing of the flow control valves 72 and 74 to adjust the refrigerant charge to coordinate with system requirements for the various modes of operation. The system controller 100 receives input signals indicative of various system operational parameters from a plurality of sensors, including, without limitation, a suction temperature sensor 81, a suction pressure sensor 83, a discharge temperature sensor 85, a discharge pressure sensor 87, a water temperature sensor 89, an outdoor heat exchanger refrigerant temperature sensor 82, an indoor heat exchanger refrigerant temperature sensor 84, and a refrigerant temperature sensor 86 disposed in operative association with section 45B of refrigerant line 45 at a location between the expansion valves 44 and 54.

The suction temperature sensor 81 and the suction pressure sensor 83 are disposed in operative association with refrigerant line 55 near the suction inlet to the compressor 20 as in conventional practice for sensing the refrigerant temperature and pressure, respectively, at the compressor suction inlet and for passing respective signals indicative thereof to the system controller 100. The discharge temperature sensor 85 and the discharge pressure sensor 87 are disposed in operative association with refrigerant line 35 near the discharge outlet to the compressor 20 as in conventional practice for sensing the refrigerant temperature and pressure, respectively, at the compressor discharge outlet and for passing respective signals indicative thereof to the system controller 100. The water temperature sensor 89 is disposed in operative association with the water reservoir 64 for sensing the temperature of the water therein and for passing a signal indicative of the sensed water temperature to the system controller 100. The temperature sensor 82 is disposed in operative association with the outdoor heat exchanger 40 at a location appropriate for measuring the refrigerant phase change temperature of refrigerant passing therethrough when the outdoor heat exchanger is operating and for sending a signal indicative of that sensed temperature to the system controller 100. Similarly, the temperature sensor 84 is disposed in operative association with the indoor heat exchanger 50 at a location appropriate for measuring the refrigerant phase change temperature of refrigerant passing therethrough when the indoor heat exchanger is operating and for sending a signal indicative of that sensed temperature to the system controller 100. The system controller 100 determines the degree of superheat from the refrigerant temperature sensed by whichever of sensors 82 and 84 is associated with the heat exchanger that is acting as an evaporator in the current operating mode. The refrigerant temperature sensor 86 operatively associated with refrigerant line 45 senses the temperature of the refrigerant at a location between the expansion valves 44 and 54 and passes a signal indicative of the sensed temperature to the system controller 100. The system controller determines the degree of subcooling present from the sensed temperature received from temperature sensor 86.

Figure 2:
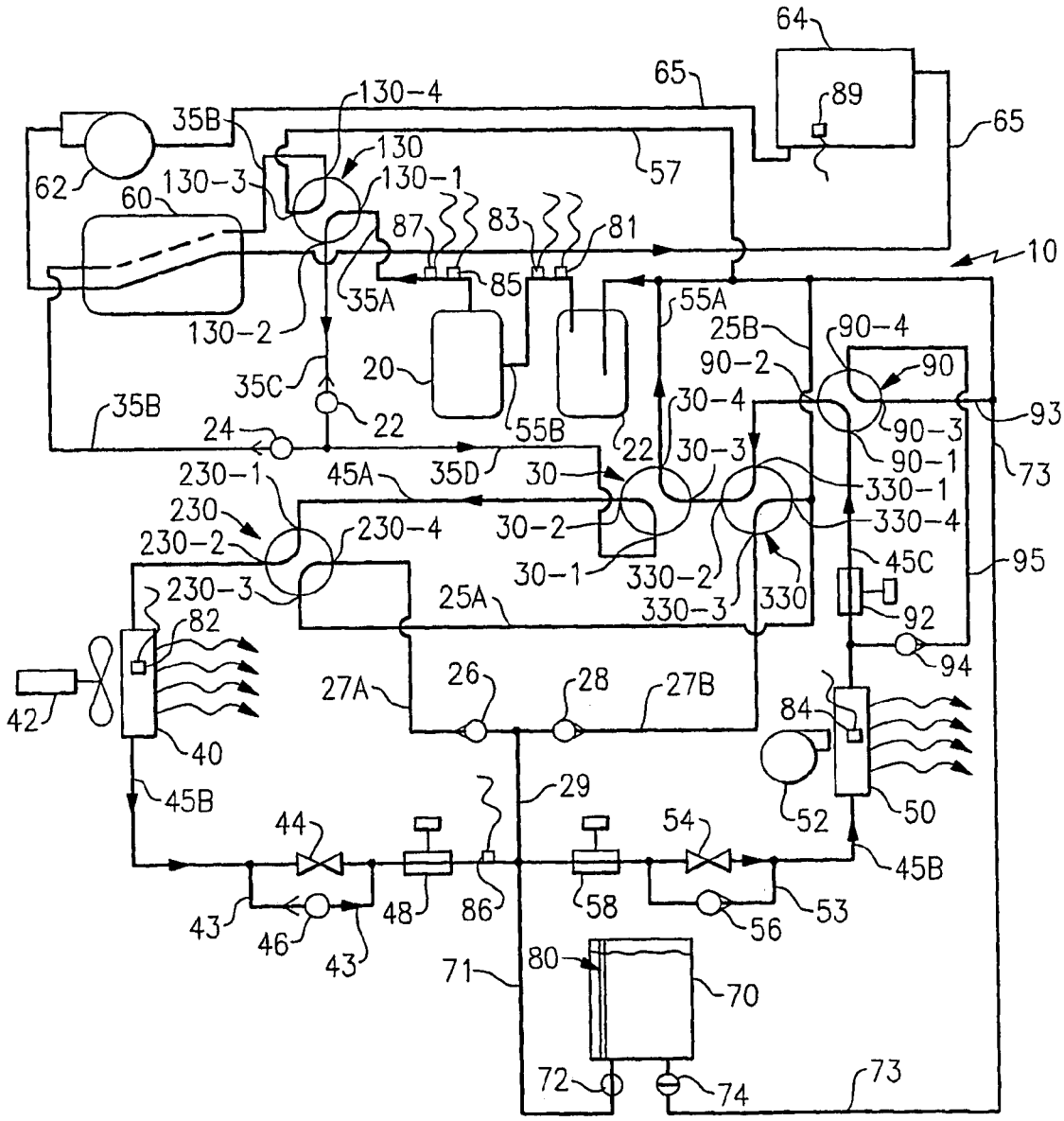
FIG. 2 is a schematic diagram illustrating a second embodiment of the heat pump system of the invention illustrating operation in an indoor air cooling only mode.

Referring now to FIGS. 1 and 2, in the indoor air cooling only mode, in response to a demand for cooling, the system controller 100 positions the reversing valve 30 in its first position, the heat exchanger bypass valve 130 in its first position, the first bypass/bleed valve 230 in its first position, the second bypass/bleed valve 330 in its first position, and activates the compressor 20, the outdoor heat exchanger fan 42 and the indoor heat exchanger fan 52. Additionally both flow control valves 48 and 58 are set in their open position. High pressure, superheated refrigerant from the compressor 20 passes through refrigerant line 35A to the first port 130-1 of the heat exchanger bypass valve 130 wherein the refrigerant is directed via the second port to and through refrigerant lines 35C and 35D to the first port 30-1 of reversing valve 30, thereby bypassing the refrigerant-to-water heat exchanger 60. In the air cooling only mode, the water pump 62 is turned off so that water is not circulating through line 65. With check valve 24 blocking back flow into refrigerant line 35B, any refrigerant resident in refrigerant line 35B is bled back through the fourth port 130-4 of the bypass valve 130 to the third port 130-3 of the bypass valve 130 and thence refrigerant line 57 to the accumulator 22 to return to the suction inlet of the compressor 20.

The refrigerant passing though refrigerant line 35D into the reversing valve 30 is directed to and through refrigerant line 45A to the outdoor heat exchanger 40, which in the air cooling mode functions as a condenser. With the outdoor heat exchanger fan 42 operating, ambient air flows through the outdoor heat exchanger 40 in heat exchange relationship with the refrigerant passing therethrough, whereby the high pressure refrigerant is condensed to a liquid and subcooled. This high pressure liquid refrigerant passes from the outdoor heat exchanger 40 through section 45B of refrigerant line 45 to the indoor heat exchanger 50, which in the air cooling mode functions as an evaporator. In passing through section 45B of refrigerant line 45, the high pressure liquid refrigerant bypass the expansion valve 44 through bypass line 43 and check valve 46 and thence passes through the expansion valve 54 wherein the high pressure liquid refrigerant expands to a lower pressure, thereby further cooling the refrigerant prior to the refrigerant entering the indoor heat exchanger 50. As the refrigerant traverses the indoor heat exchanger 50, the refrigerant evaporates. With the indoor heat exchanger fan 52 operating, indoor air passes through the indoor heat exchanger 50 in heat exchange relationship with the refrigerant thereby evaporating the refrigerant and cooling the indoor air.

In the FIG. 1 embodiment of the system 10, the refrigerant vapor passes from the indoor heat exchanger 50 through section 45C of refrigerant line 45 directly to and through the second bypass/bleed valve 330 to the reversing valve 30 wherein it is directed through section 55A of refrigerant line 55 to the suction accumulator 22 before returning to the compressor 20 through section 55B of refrigerant line 55 connecting to the suction inlet of the compressor 20. In the FIG. 2 embodiment of the system 10, however, the suction line bleed valve 90 is disposed in the refrigerant circuit between the indoor heat exchanger 50 and the second bypass/bleed valve 330. Thus, the refrigerant vapor passes from the indoor heat exchanger 50 through section 45C of refrigerant line 45 directly to the first port 90-1, rather than directly to the first port 330-1 of the second bypass/bleed valve 330. With the suction line bypass/bleed valve 90 positioned in its first position and the bypass flow control valve 92 positioned in its open position, as illustrated in FIG. 2, the refrigerant vapor passes through the suction line bypass/bleed valve 90 via ports 90-1 and 90-2 to and through the second bypass/bleed valve 330 to the reversing valve 30 wherein it is directed through section 55A of refrigerant line 55 to the suction accumulator 22 before returning to the compressor 20 through section 55B of refrigerant line 55 connecting to the suction inlet of the compressor 20. Additionally, lines 93 and 95 are also connected in flow communication by the suction line bypass valve 90 via ports 90-3 and 90-4, and flow into line 95 from refrigerant line 45C is blocked by check valve 94.

Figure 3:
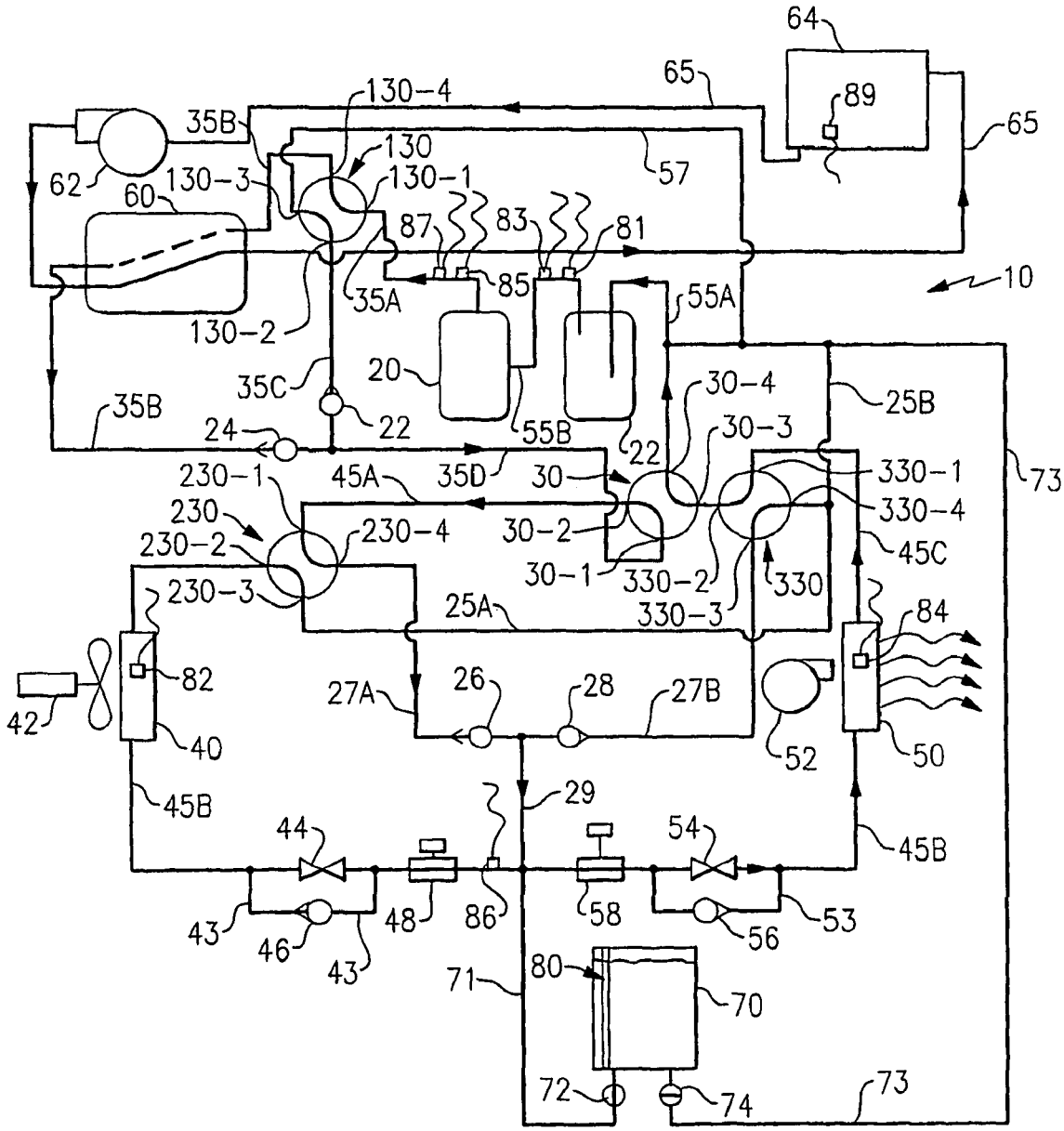
FIG. 3 is a schematic diagram illustrating a first embodiment of the heat pump system of the invention illustrating operation in an indoor air cooling with water heating mode.
Figure 4:
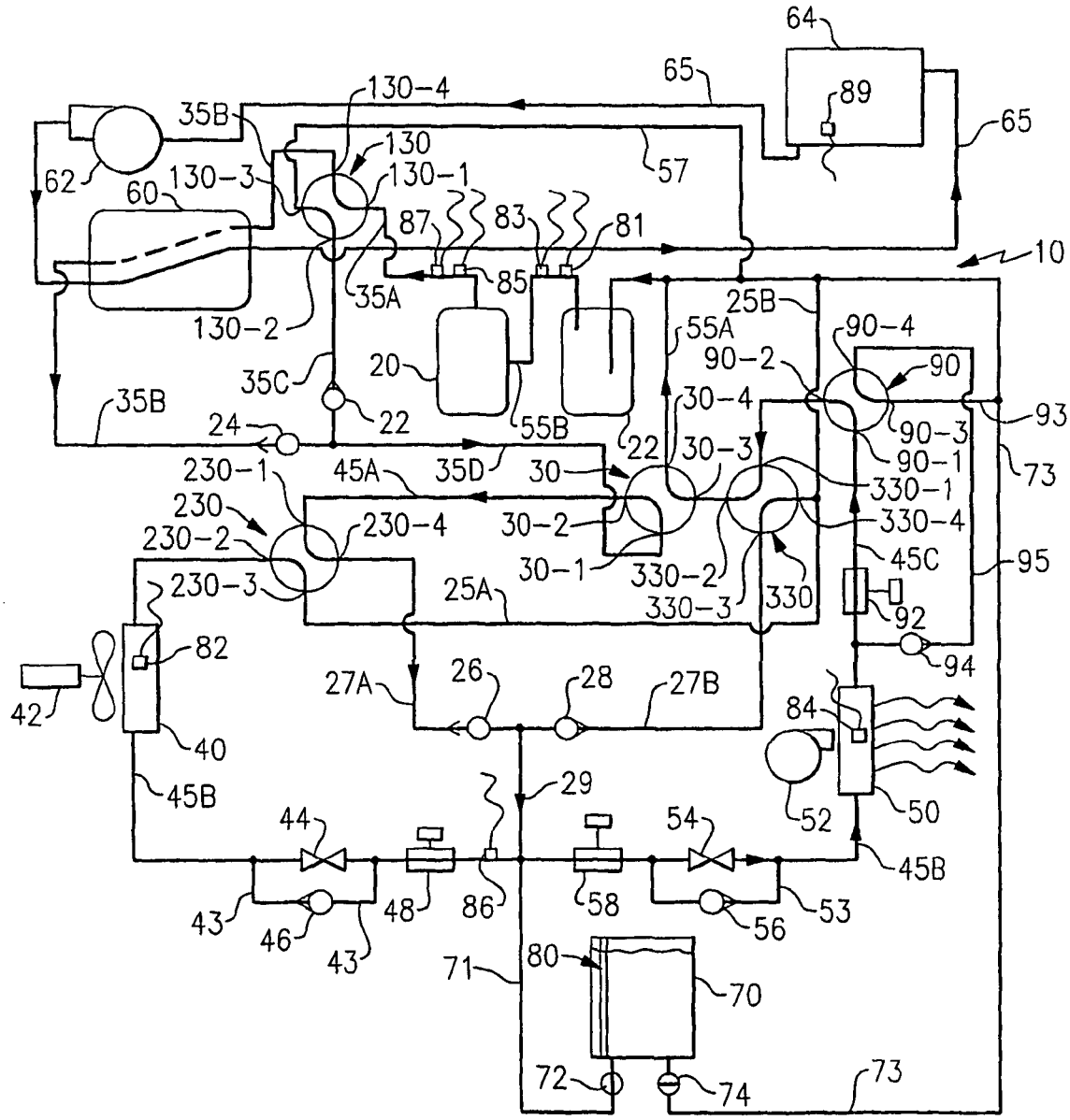
FIG. 4 is a schematic diagram, illustrating a second embodiment of the heat pump system of the invention illustrating operation in an indoor air cooling with water heating mode.

Referring now to FIGS. 3 and 4, when there is a demand for water heating in conjunction with indoor air cooling, the system controller 100 repositions the heat exchanger bypass valve 130 from its first position into its second position and also repositions the first bypass/bleed valve 230 from its first position into its second position, while leaving the reversing valve 30 in its first position and the second bypass/bleed valve 330 in its first position. The controller also activates the water pump 62 in addition to the compressor 20 and the indoor heat exchanger fan 52, but shuts down the outdoor heat exchanger fan 42 and closes the flow control valve 48. With the heat exchanger bypass valve 130 in its second position, high pressure, superheated refrigerant from the compressor 20 passes through refrigerant line 35A to the first port 130-1 of the heat exchanger bypass valve 130 wherein the refrigerant is directed via the fourth port 130-4 to and through refrigerant lines 35B and 35D to the first port 30-1 of reversing valve 30, thereby passing through refrigerant-to-water heat exchanger 60. With the water pump 62 activated, water is pumped via water line 65 from storage tank 64 through heat exchanger 60 in heat exchange relationship with the high pressure superheated refrigerant flowing through refrigerant line 35B.

As the refrigerant passes through the heat exchanger 60, the refrigerant is condensed and subcooled as it gives up heat to heat the water flowing through the heat exchanger 60 in heat exchange relationship with the refrigerant. Since in this air cooling with water heating mode, the refrigerant passing into section 45A of refrigerant line 45 has already been condensed and subcooled when passing through the heat exchanger 60 in heat exchange relationship with the water, there is no need for any significant further cooling in the outdoor heat exchanger. Further, additional subcooling would decrease the water heating capacity. As the first bypass/bleed valve 230 is in its second position in this indoor air cooling with water heating mode, the high pressure liquid refrigerant passing into the first bypass/bleed valve 230 through its first port 230-1 is directed through its fourth port 230-4 into refrigerant line 27A, thereby bypassing the outdoor heat exchanger 40, and thence through refrigerant line 29 and the open flow control valve 58 to and through the indoor heat exchanger 50 via refrigerant line 45B. With flow control valve 48 shut and the first bypass/bleed valve 230 in its second position, any refrigerant resident in the outdoor heat exchange is bled back through the first bypass/bleed valve 230 via its second port 230-2 and third port 230-3 to and through refrigerant lines 25A and 25B to the accumulator 22 to return to the suction inlet of the compressor 20.

In passing through refrigerant line 45B, the high pressure liquid refrigerant passes through the expansion valve 54 wherein the high pressure liquid refrigerant expands to a lower pressure, thereby further cooling the refrigerant prior to the refrigerant entering the indoor heat exchanger 50. As the refrigerant traverses the indoor heat exchanger, the refrigerant evaporates. With the indoor heat exchanger fan 52 operating, indoor air passes through the indoor heat exchanger 50 in heat exchange relationship with the refrigerant thereby evaporating the refrigerant and cooling the indoor air. In the FIG. 3 embodiment of the system 10, the refrigerant vapor passes from the indoor heat exchanger 50 through section 45C of refrigerant line 45 directly to and through the second bypass/bleed valve 330 to the reversing valve 30 wherein it is directed through section 55A of refrigerant line 55 to the suction accumulator 22 before returning to the compressor 20 though section 55B of refrigerant-line 55 connecting to the suction inlet of the compressor 20.

In the FIG. 4 embodiment of the system 10, however, the suction line bleed valve 90 is disposed in the refrigerant circuit between the indoor heat exchanger 50 and the second bypass/bleed valve 330. Thus, the refrigerant vapor passes from the indoor heat exchanger 50 through section 45C of refrigerant line 45 directly to the first port 90-1, rather than directly to the first port 330-1 of the second bypass/bleed valve 330. In the air cooling with water heating mode, the suction line bypass/bleed valve 90 and the flow control valve 92 are positioned as in the air cooling only mode, with the suction line bypass valve 90 being positioned in its first position and the bypass flow control valve 92 being in its open position. Therefore, the refrigerant vapor passes through the suction line bypass/bleed valve 90 via ports 90-1 and 90-2 to and through the second bypass/bleed valve 330 to the reversing valve 30 wherein it is directed through section 55A of refrigerant line 55 to the suction accumulator 22 before returning to the compressor 20 through section 55B of refrigerant line 55 connecting to the suction inlet of the compressor 20. Additionally, lines 93 and 95 are also connected in flow communication by the suction line bypass valve 90 via ports 90-3 and 90-4, and flow into line 95 from refrigerant line 45C is blocked by check valve 94.

Figure 5:
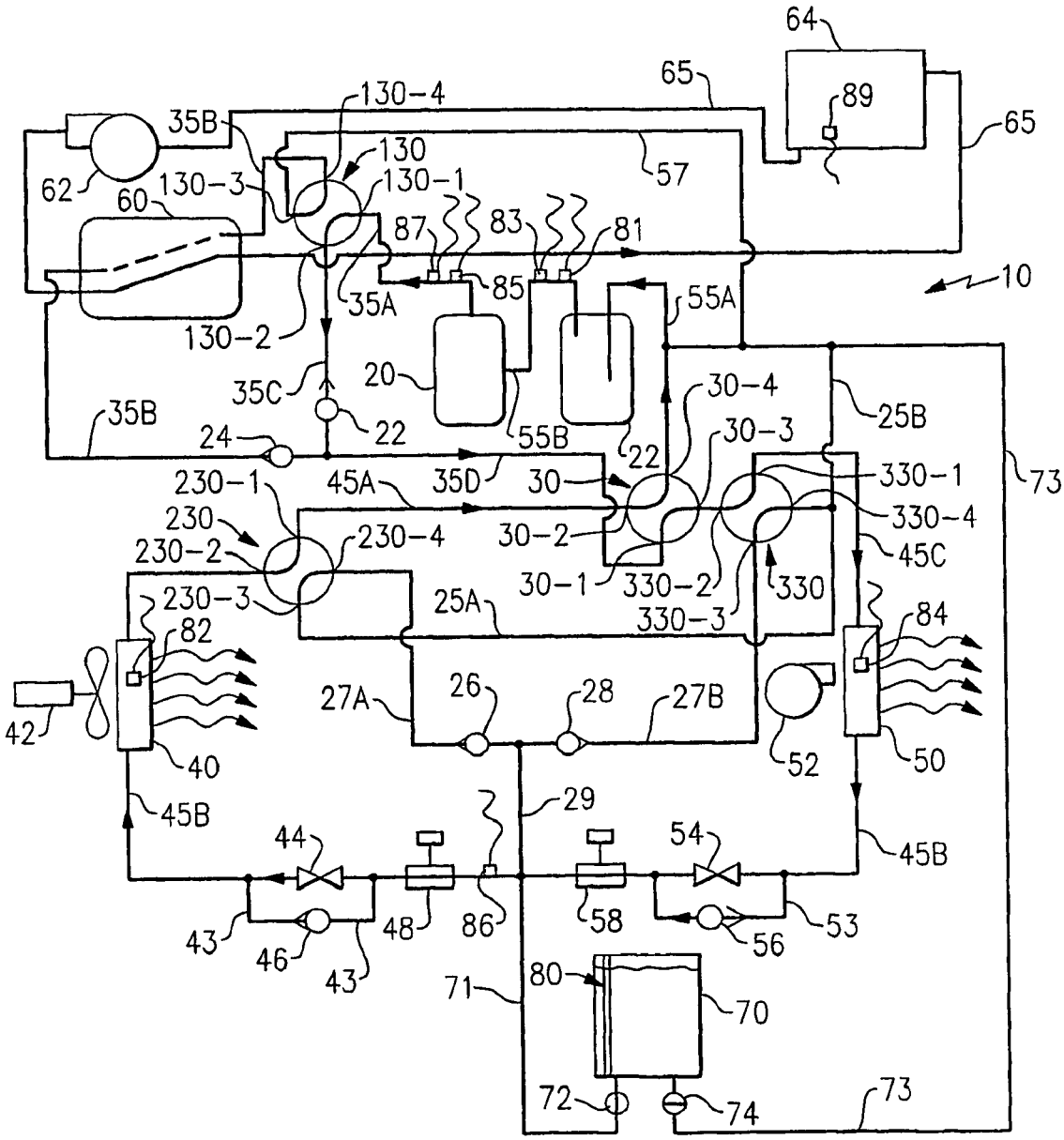
FIG. 5 is a schematic diagram illustrating a first embodiment of the heat pump system of the invention illustrating operation in an indoor air heating only mode.
Figure 6:
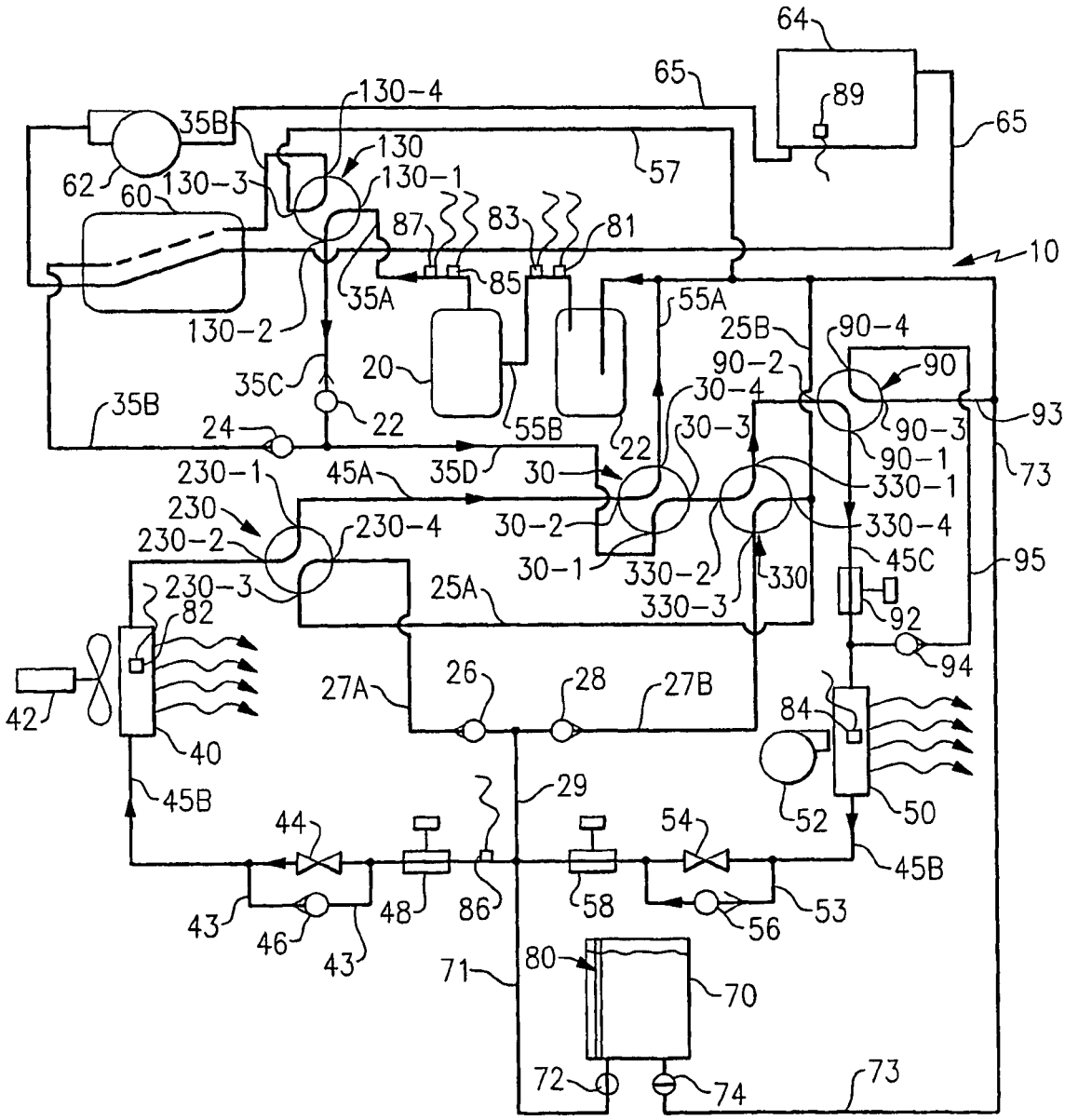
FIG. 6 is a schematic diagram illustrating a second embodiment of the heat pump system of the invention illustrating operation in an indoor air heating only mode.

Referring now to FIGS. 5 and 6, in the indoor air beating only mode, in response to a demand for heating, the system controller 100 positions the reversing valve 30 in its second position, the heat exchanger bypass valve 130 in its first position, the first bypass/bleed valve 230 in its first position, the second bypass/bleed valve 330 in its first position, and activates the compressor 20, the outdoor heat exchanger fan 42 and the indoor heat exchanger fan 52. Additionally both flow control valves 48 and 58 are set in their open position. High pressure, superheated refrigerant from the compressor 20 passes through refrigerant line 35A to the first port 130-1 of the heat exchanger bypass valve 130 wherein the refrigerant is directed via the second port to and through refrigerant lines 35C and 35D to the first port 30-1 of reversing valve 30, thereby bypassing the refrigerant-to-water heat exchanger 60. With the reversing valve 30 positioned in its second position, the refrigerant passing though refrigerant line 35D into the reversing valve 30 is directed via the first port 30-1 and the second port 30-2 thereof to second port 330-2 of the second bypass/bleed 330 wherein the refrigerant is directed by the second port 330-2 and the first port 330-1 thereof into section 45C of refrigerant line 45 and therethrough to the indoor heat exchanger 50, which in the air heating mode functions as a condenser. In the air heating only mode, the water pump 62 is off so that water is not circulating through line 65. With check valve 24 blocking back flow into refrigerant line 35B, any refrigerant resident in refrigerant line 35B is bled back through the fourth port 130-4 of the bypass valve 130 to the third port 130-3 of the bypass valve 130 and thence refrigerant line 57 to the accumulator 22 to return to the suction inlet of the compressor 20.

With the indoor heat exchanger fan 52 operating, indoor air passes through the indoor heat exchanger 50 in heat exchange relationship with the refrigerant passing therethrough, whereby the high pressure refrigerant is condensed to a liquid and subcooled, and the indoor air is heated. High pressure liquid refrigerant passes from the indoor heat exchanger 50 through section 45B of refrigerant line 45 to the outdoor heat exchanger 40, which in the air heating mode functions as an evaporator. In passing through section 45B of refrigerant line 45, the high pressure liquid refrigerant bypass the expansion valve 54 through bypass line 53 and check valve 56 and thence passes through the expansion valve 44 wherein the high pressure liquid refrigerant expands to a lower pressure, thereby further cooling the refrigerant prior to the refrigerant entering the outdoor heat exchanger 40. With the outdoor heat exchanger fan 42 operating, ambient air passes through the outdoor heat exchanger and as the refrigerant traverses the outdoor heat exchanger, the refrigerant evaporates. The refrigerant passes from the outdoor heat exchanger 40 through section 45A of refrigerant line 45 to and through the first bypass/bleed valve 230 via the second port 230-2 and the first port 230-1 thereof to the reversing valve 30 wherein the refrigerant vapor is directed via the second port 30-2 and the fourth port 30-4 thereof to and through refrigerant line 55A to the suction accumulator 22 before returning to the compressor 20 through section 55B of refrigerant line 55 connecting to the suction inlet of the compressor 20.

In the FIG. 6 embodiment of the system 10, the suction line bleed valve 90 is disposed in the refrigerant circuit between the indoor heat exchanger 50 and the second bypass/bleed valve 330. Thus, the refrigerant vapor passing through the second bypass/bleed valve 330 via ports 330-2 and 330-1 thereof passes to the second port 90-2 of the suction line bypass valve 90. In the air heating only mode, the suction line bypass/bleed valve 90 and the flow control valve 92 are positioned as in the air cooling only mode, with the suction line bypass valve 90 being positioned in its first position and the bypass flow control valve 92 being in its open position. Therefore, the high pressure liquid refrigerant passes through the suction line bypass/bleed valve 90 via ports 90-2 and 90-1 and thence through refrigerant line 45C to the indoor heat exchanger 50. Additionally, lines 93 and 95 are also connected in flow communication by the suction line bypass valve 90 via ports 90-3 and 90-4, and flow into line 95 from refrigerant line 45C is blocked by check valve 94.

Figure 7:
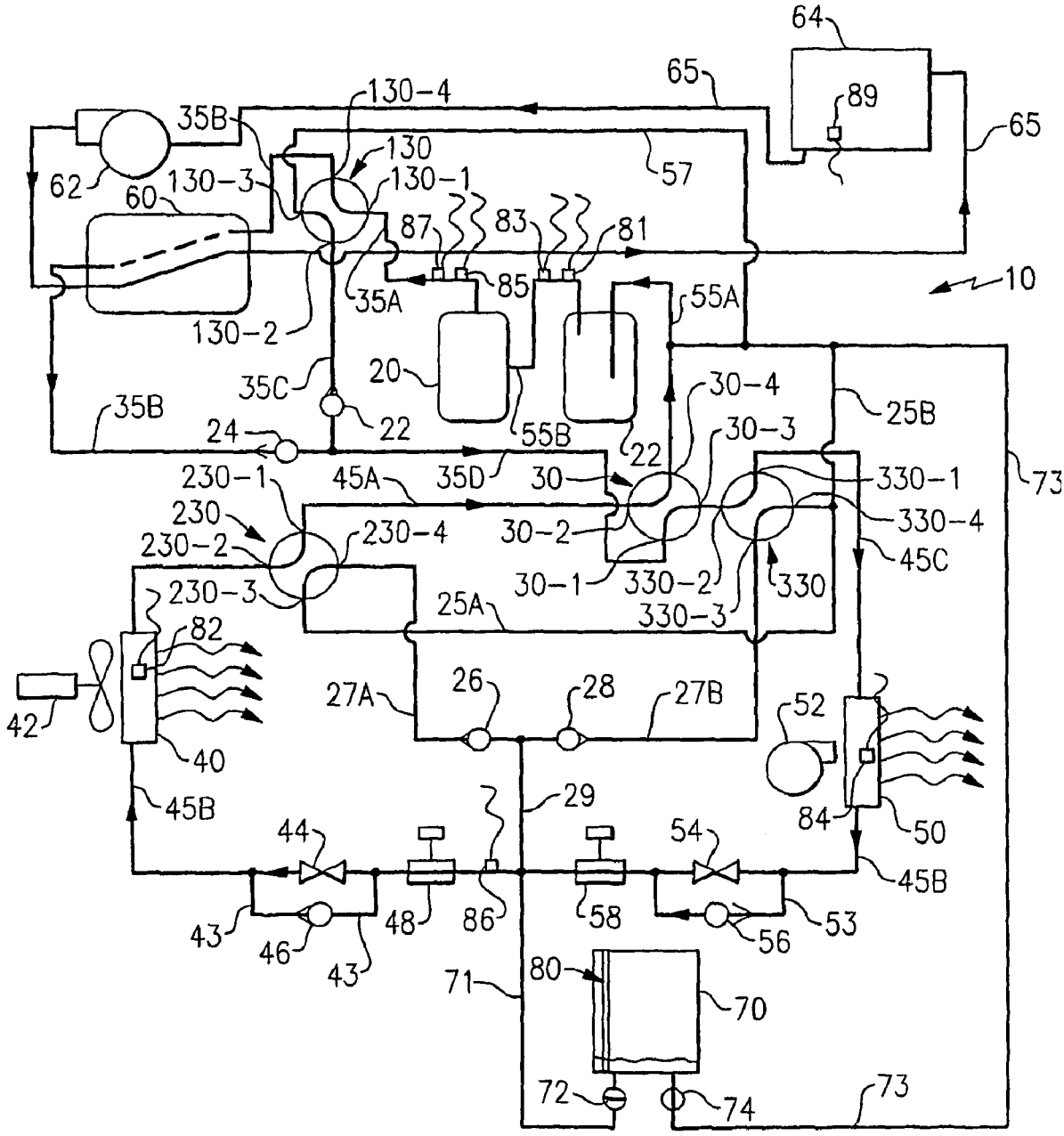
FIG. 7 is a schematic diagram illustrating a first embodiment of the heat pump system of the invention illustrating operation in an indoor air heating with water heating mode.
Figure 8:
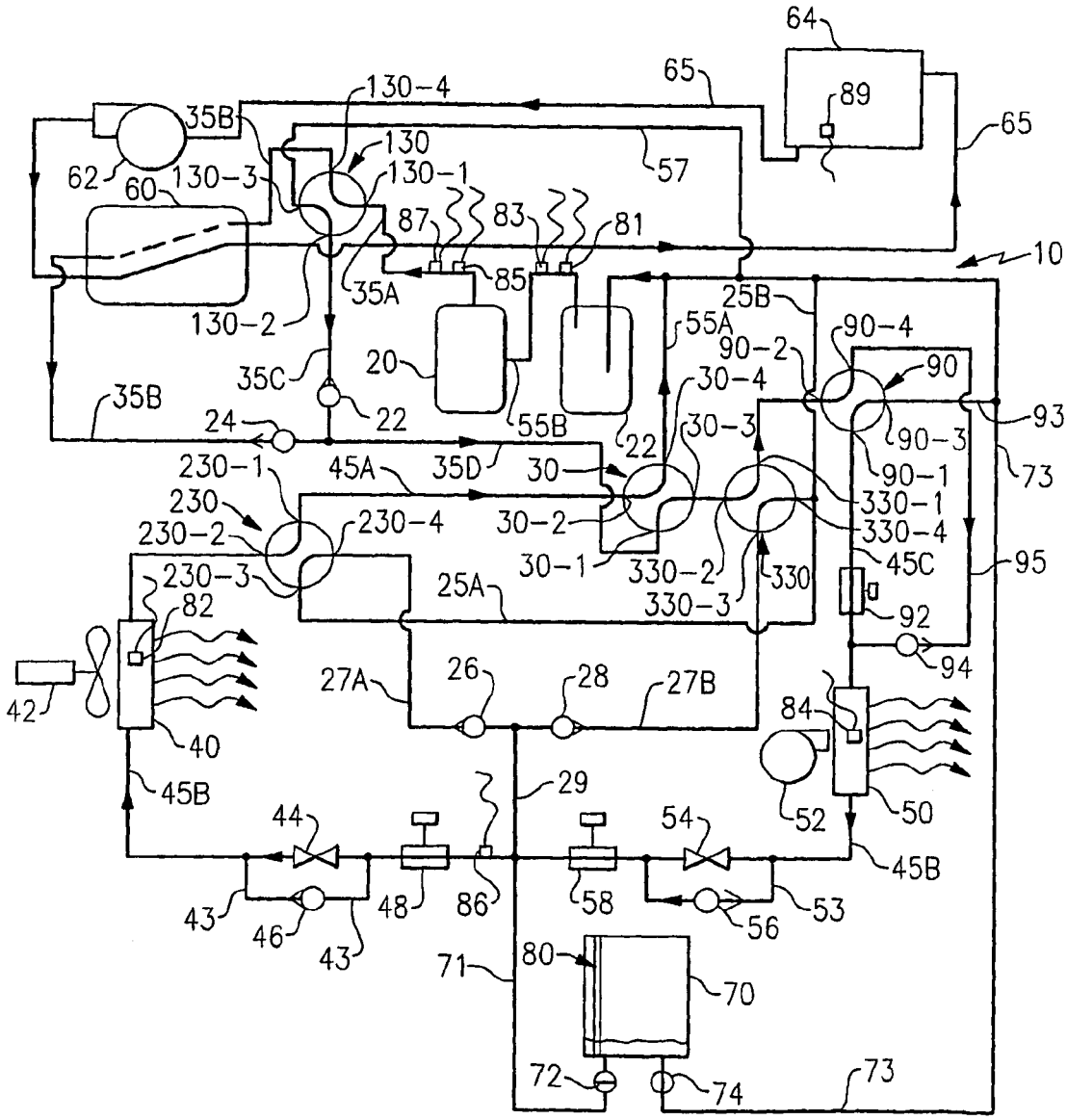
FIG. 8 is a schematic diagram illustrating a second embodiment of the heat pump system of the invention illustrating operation in an indoor air heating with water heating mode.

Referring now to FIGS. 7 and 8, when there is a demand for water heating in conjunction with the indoor air heating mode, the system controller 100 positions the reversing valve 30 in its second position, the heat exchanger bypass valve 130 in its second position, the first bypass/bleed valve 230 in its first position, and the second bypass/bleed valve 330 in its first position. The controller also activates the water pump 62 in addition to the compressor 20, the outdoor heat exchanger fan 42 and the indoor heat exchanger fan 52. Additionally both flow control valves 48 and 58 are set in their open position. With the heat exchanger bypass valve 130 in its second position, high pressure, superheated refrigerant from the compressor 20 passes through refrigerant line 35A to the first port 130-1 of the heat exchanger bypass valve 130 wherein the refrigerant is directed via the fourth port 130-4 to and through refrigerant lines 35B and 35D to the first port 30-1 of reversing valve 30, thereby passing through refrigerant-to-water heat exchanger 60. The controller 100 also activates the water pump 60 and water is pumped via water line 65 from storage tank 64 through heat exchanger 60 in heat exchange relationship with the high pressure superheated vapor refrigerant flowing through refrigerant line 35B.

With the reversing valve 30 positioned in its second position, the refrigerant passing though refrigerant line 35D into the reversing valve 30 is directed via the first port 30-1 and the second port 30-2 thereof to second port 330-2 of the second bypass/bleed 330 wherein the refrigerant is directed by the second port 330-2 and the first port 330-1 thereof to and through section 45C of refrigerant line 45 to the indoor heat exchanger 50, which in the air heating mode functions as a condenser. With the indoor heat exchanger fan 52 operating, indoor air passes through the indoor heat exchanger 50 in heat exchange relationship with the refrigerant passing therethrough, whereby the high pressure refrigerant is condensed to a liquid and subcooled and the indoor air is heated. High pressure liquid refrigerant passes from the indoor heat exchanger 50 through section 45B of refrigerant line 45 to the outdoor heat exchanger 40, which in the air heating mode functions as an evaporator. In passing through section 45B of refrigerant line 45, the high pressure liquid refrigerant bypass the expansion valve 54 through bypass line 53 and check valve 56 and thence passes through the expansion valve 44 wherein the high pressure liquid refrigerant expands to a lower pressure, thereby further cooling the refrigerant prior to the refrigerant entering the outdoor heat exchanger 40. With the outdoor heat exchanger fan 42 operating, ambient air passes through the outdoor heat exchanger and as the refrigerant traverses the outdoor heat exchanger, the refrigerant evaporates. The refrigerant passes from the outdoor heat exchanger 40 through section 45A of refrigerant line 45 to and through the first bypass/bleed valve 230 via the second port 230-2 and the first port 230-1 thereof to the reversing valve 30 wherein the refrigerant vapor is directed via the second port 30-2 and the fourth port 30-4 thereof to and through refrigerant line 55A to the suction accumulator 22 before returning to the compressor 20 through section 55B of refrigerant line 55 connecting to the suction inlet of the compressor 20.

In the FIG. 8 embodiment of the system 10, the suction line bleed valve 90 is disposed in the refrigerant circuit between the indoor heat exchanger 50 and the second bypass/bleed valve 330. Thus, the refrigerant vapor passing through the second bypass/bleed valve 330 via ports 330-2 and 330-1 thereof passes to the second port 90-2 of the suction line bypass valve 90. In the air heating with water heating mode, the suction line bypass valve 90 is positioned in its second position and the flow control valve 92 is positioned in its closed position. With the suction line bypass valve 90 being positioned in its second, the high pressure liquid refrigerant passes through the suction line bypass/bleed valve 90 via ports 90-2 and 90-4 and thence through refrigerant line 95 and check valve 94 to the indoor heat exchanger 50. Additionally, line 93 and section 45C of the refrigerant line 45 are connected in flow communication by the suction line bypass valve 90 via ports 90-1 and 90-3, and flow into line 45C from refrigerant line 95 is blocked by the closed flow control valve 92. Any refrigerant resident in section 45C of the refrigerant line 45 is bled to the suction accumulator through refrigerant lines 93 and 73.

Referring now to FIGS. 9 and 10, when there is a demand for water heating while the heat pump is not also in either the indoor air cooling or air heating mode, the system controller 100 positions the reversing valve 30 in its second position, the heat exchanger bypass valve 130 in its second position, the first bypass/bleed valve 230 in its first position, and the second bypass/bleed valve 330 in its second position. The controller 100 also activates the water pump 62 in addition to the compressor 20 and the outdoor heat exchanger fan 52, but shuts down the indoor heat exchanger fan 52 and closes the flow control valve 58. With the heat exchanger bypass valve 130 in its second position, high pressure, superheated refrigerant from the compressor 20 passes through refrigerant line 35A to the first port 130-1 of the heat exchanger bypass valve 130 wherein the refrigerant is directed via the fourth port 130-4 to and through refrigerant lines 35B and 35D to the first port 30-1 of reversing valve 30, thereby passing through refrigerant-to-water heat exchanger 60. With the water pump 62 activated, water is pumped via water line 65 from storage tank 64 through heat exchanger 60 in heat exchange relationship with the high pressure superheated refrigerant flowing though refrigerant line 35B. As the refrigerant passes through the heat exchanger 60, the refrigerant is condensed and subcooled as it gives up heat to heat the water flowing through the heat exchanger 60 in heat exchange relationship with the refrigerant.

With the reversing valve 30 positioned in its second position, the refrigerant passing though refrigerant line 35D into the reversing valve 30 is directed via the first port 30-1 and the third port 30-3 thereof to second port 330-2 of the second bypass/bleed 330. As the second bypass/bleed valve 330 is in its second position in this water heating only mode, the high pressure liquid refrigerant passing into the second bypass/bleed valve 330 through its second port 330-2 is directed through its third port 330-3 into refrigerant line 27B, thereby bypassing the indoor heat exchanger 50, and thence through refrigerant line 29 and the open flow control valve 48 to and through the outdoor heat exchanger 40 via refrigerant line 45B. In passing through refrigerant line 45B, the high pressure liquid refrigerant passes through the expansion valve 44 wherein the high pressure liquid refrigerant expands to a lower pressure, thereby farther cooling the refrigerant prior to the refrigerant entering the outdoor heat exchanger 40. As the refrigerant traverses the outdoor heat exchanger, the refrigerant evaporates. With the outdoor heat exchanger fan 42 operating, ambient air passes through the outdoor heat exchanger 40 in heat exchange relationship with the refrigerant thereby evaporating the refrigerant. The refrigerant vapor passes from the outdoor heat exchanger 40 through section 45A of refrigerant line 45 through the first bypass/bleed valve 230 via its second port 230-2 and first port 230-1 to the reversing valve 30 wherein it is directed via its second port 30-2 and fourth port 30-4 through refrigerant line 55A to the suction accumulator 22 before returning to the compressor 20 through refrigerant line 55B connecting to the suction inlet of the compressor 20.

With flow control valve 58 shut and the second bypass/bleed valve 330 in its second position, any refrigerant resident in the indoor heat exchanger 50 is bled back through the second bypass/bleed valve 330 via its first port 330-1 and fourth port 330-4 to and through refrigerant line 25B to the accumulator 22 to return to the suction inlet of the compressor 20. In the embodiments depicted in FIGS. 10A and 10B, wherein the suction line bleed valve 90 is disposed in the refrigerant circuit between the second bypass/bleed valve 330 and the indoor heat exchanger 50, any refrigerant resident in the indoor heat exchanger 50 is bled back through refrigerant line 45C and the open flow control valve 92 to and through the suction line bypass valve 90 via its second port 90-2 which is connected externally in fluid flow communication with the first port 330-1 of the second bypass/bleed valve 330. The suction line bypass valve may be positioned in either its first position, as depicted in FIG. 10A, or in its second position, as depicted in FIG. 10B. Referring now to FIG. 10A, with the suction line bypass valve in its first position, with the flow control valve 58 closed, any refrigerant resident in the indoor heat exchanger 50 is bled back through the suction line bypass valve 90 via ports 90-1 and 90-2 thereof and through bypass/bleed valve 330 via its first port 330-1 and fourth port 330-4 to and through refrigerant line 25B and refrigerant line 55A to the accumulator 22 to return to the suction inlet of the compressor 20. Referring now to FIG. 10B, with the suction line bypass valve in its second position, with the flow control valve 58 closed, any refrigerant resident in the indoor heat exchanger 50 is bled back through the suction line bypass valve 90 via ports 90-1 and 90-3 thereof through refrigerant lines 93 and 55A to the suction accumulator 22 to return to the suction inlet of the compressor 20.

As noted hereinbefore, the heat pump system of the invention must operate effectively in an air cooling only mode, an air cooling and water heating mode, an air heating only mode, an air heating and water heating mode, and a water heating only mode. As both the outdoor heat exchanger 40 and the indoor heat exchanger 50 operate as evaporator, condenser or subcooler, or are bypassed, depending on the mode and point of operation, condensing may occur in one or two heat exchangers, and the suction line may be filled with refrigerant in a gaseous or liquid state. As a consequence, the amount of system refrigerant charge required in each mode in order to ensure operation within an acceptable efficiency envelope will be different for each mode. When water heating is not required, the amount of refrigerant charge required will also be affected by the amount of heat exchange due to the occurrence of thermo-siphoning in the refrigerant-to-water heat exchanger 60.

Accordingly, the system controller system 100 controls the amount of refrigerant flowing through the refrigerant circuit at any time, i.e. the refrigerant charge, by monitoring and adjusting the level of refrigerant in the charge tank 70 by selectively opening and closing the first flow control valve 72 disposed in the refrigerant line 71 and a second flow control valve 74 disposed in the refrigerant line 73. The controller 100 uses input from the various sensors, including the refrigerant temperature sensors 82 and 84 to calculate the degree of superheat and the degree of subcooling present in the system, which are used by the controller 100 in positioning the flow control valves 72 and 74 associated with the charge tank 70 as discussed hereinafter.

In a most advantageous embodiment, the charge tank 70 is provided with a liquid level meter 80 that generates and transmits a signal indicative of the refrigerant level within the charge tank 70 to the system controller 100. The liquid level meter 80 may be configured to transmit a liquid level signal to the system controller 100 continuously, on a periodic basis at specified intervals, or only when prompted by the controller. Referring now to FIG. 10, in operation, when the controller switches from one mode of operation to a new mode of operation, the controller 100 turns on the compressor 20 at block 101, and then, at block 102, the controller 100 compares the then current liquid level in the charge tank 70 with the liquid level last experienced the last time the system was operated in a mode equivalent to the new mode of operation, the liquid level last experienced having been stored in the controller's memory. If the current level is the same as the last experienced level for this particular mode of operation, the controller at block 105 activates the discharge temperature control procedure and/or at block 106 the normal charge control procedure.

However, if the current liquid level is not the same as the last experienced level for this particular mode of operation, the controller 100 will selectively modulate the solenoid valves 72 and 74 to open and close as necessary to adjust the current liquid level to equal the last experienced level for this particular mode of operation. If the current level is below the last experienced level, at block 103 the controller 100 will close the solenoid valve 74 and modulate the solenoid valve 72 open to drain refrigerant from the refrigerant circuit into the charge tank 70 until the current reaches the last experience level. Conversely, if the current level is above the last experienced level, the controller 100 at block 104 will close the solenoid valve 72 and modulate the solenoid valve 74 open to drain refrigerant from the charge tank 70 into the refrigerant circuit until the current liquid level reaches the last experienced level. For example, the controller will open the appropriate valve for a short period of time, for example 2 seconds, close the valve, recheck the level and repeat this sequence until the current liquid level equalizes to the last experience level. Once the current level has been equalized to the last experienced level, the controller activates the normal charge control procedure and/or discharge temperature control procedure.

The system controller 100 may also employ the control procedure discussed herein in embodiments of the heat pump system of the invention that do not include a liquid level sensor in association with the charge tank 70. However, when the heat pump system switches to a new operation mode, the system controller 100 first fills the charge tank with refrigerant in the liquid state or with refrigerant in the gas state depending upon the particular mode of operation being entered.

If the new mode of operation does not involve water heating, the system controller will proceed according to the procedure illustrated by the block diagram in FIG. 11 to fill the refrigerant tank 70 with liquid refrigerant. After turning the compressor 20 on at block 201, the system controller at block 202 closes solenoid valve 74 and opens solenoid valve 72 to allow liquid refrigerant to pass from line 71 into the charge tank 70. After a programmed time delay at block 203 sufficient to allow the charge tank 70 to fill with liquid refrigerant, for example about 3 minutes, the system controller proceeds to adjust the refrigerant circuit charge as need by the discharge temperature control procedure and/or the charge control procedure at block 205 as desired. The solenoid valve 72 may be positioned either open or closed at this point.

Figure 12:
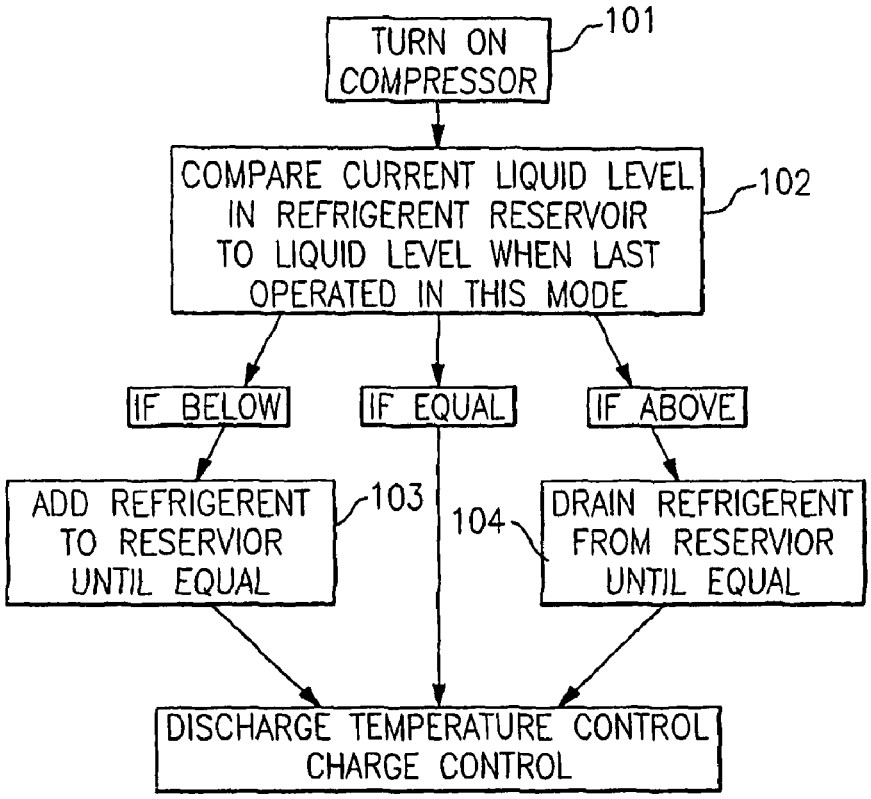
FIG. 12 is block diagram illustrating a first embodiment of a refrigerant charge adjustment procedure at start-up in a new mode of operation.

However, if the new mode of operation does involve water heating, the system controller will proceed according to the procedure illustrated by the block diagram in FIG. 12 to fill the refrigerant tank 70 with gaseous refrigerant. After turning the compressor 20 on at block 211, the system controller at block 212 closes solenoid valve 72 and modulates solenoid valve 74 on/off for a period of time, for example open 3 seconds, closed 17 seconds repeatedly for two minutes, to allow refrigerant in the gas state to pass from line 73 into the charge tank 70. After a programmed time delay at block 213 sufficient to allow the charge tank 70 to fill with gaseous refrigerant, for example about 3 minutes, the system controller proceeds to adjust the refrigerant circuit charge as need by the discharge temperature control procedure at block 214 and the charge control procedure at block 215 as desired. The solenoid valve 74 may be positioned either open or closed at this point. In any water heating mode, the controller 100 will shut the pump 62 off when temperature sensor 89 detects that the water temperature in water reservoir 64 has reached a desired limit value, for example 60 degrees C.

Figure 13:
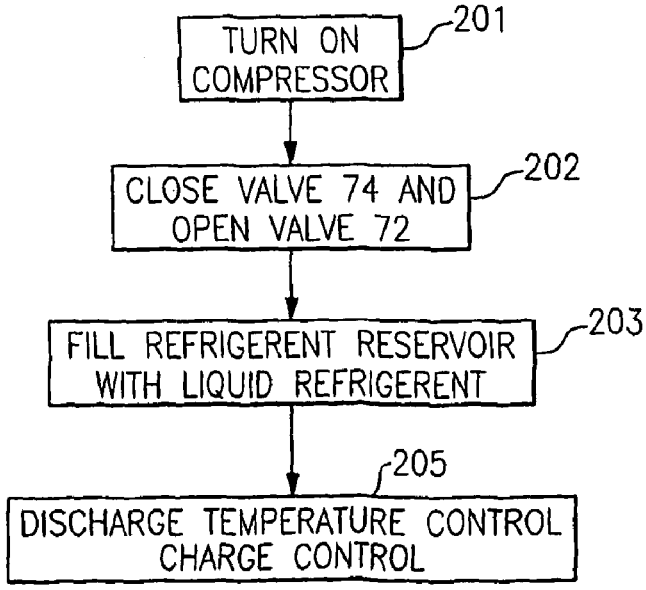
FIG. 13 is a block diagram illustrating a second embodiment of a refrigerant charge adjustment procedure at start-up in a new mode of operation.

In accord with the discharge temperature limit control procedure, illustrated by the block diagram of FIG. 13, upon entering a fixed expansion mode, after turning the compressor 20 on at block 301 and a brief time delay, for example about 30 seconds, the system controller at block 302 compares the current discharge temperature, TDC, i.e. the temperature of the refrigerant discharging from the compressor 20, received from temperature sensor 85 to a discharge temperature limit, TDL, preprogrammed into the controller 100. A typical compressor discharge limit might be a desired number of degrees, for example about 7 degrees C., below the manufacturer's application guide specification. A typical compressor discharge temperature limit would be about 128 degrees C. If the current discharge temperature, TDC, exceeds the discharge temperature limit, the system controller 100 at block 303 deactivates the charge control procedure if it is currently active, and then at block 304 closes the solenoid valve 72 and modulates the solenoid valve 74 open to drain refrigerant from the charge tank 70 into the refrigerant circuit through the refrigerant line 73. If the current discharge temperature received from temperature sensor 85 is equal to or below the discharge temperature limit, the system controller 100 at block 305 activates the charge control procedure if it is not currently active and proceeds to follow the charge control procedure to adjust the refrigerant charge in the refrigerant circuit as necessary.

Figure 14:
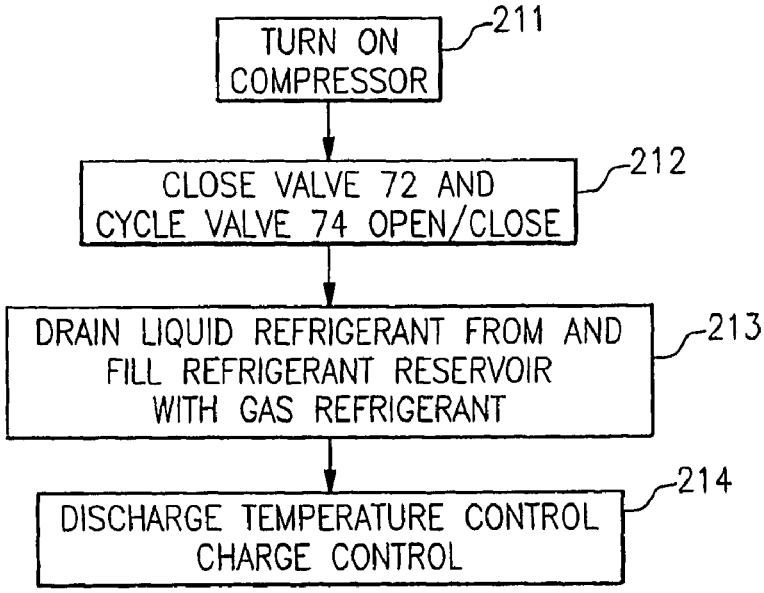
FIG. 14 is a block diagram illustrating a third embodiment of a refrigerant charge adjustment procedure at start-up in a new mode of operation.
Figure 15:
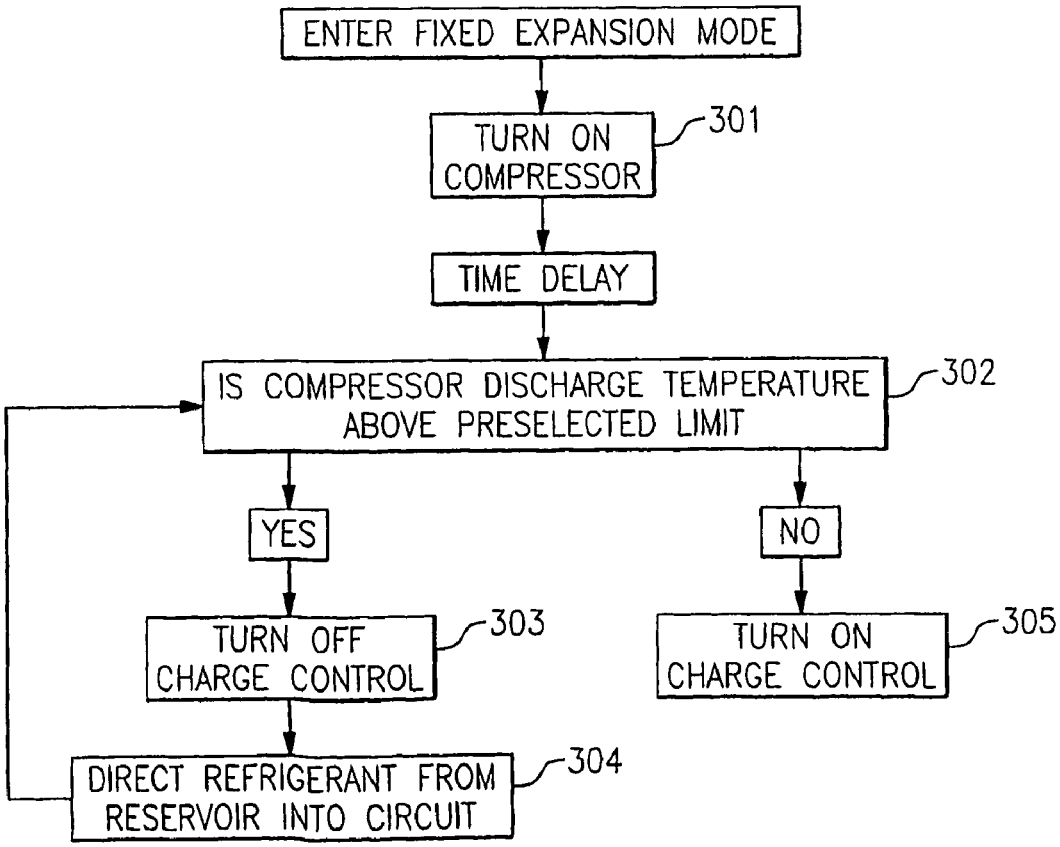
FIG. 15 is a block diagram illustrating a discharge temperature limit control procedure for adjusting refrigerant charge post start-up.
Figure 16:
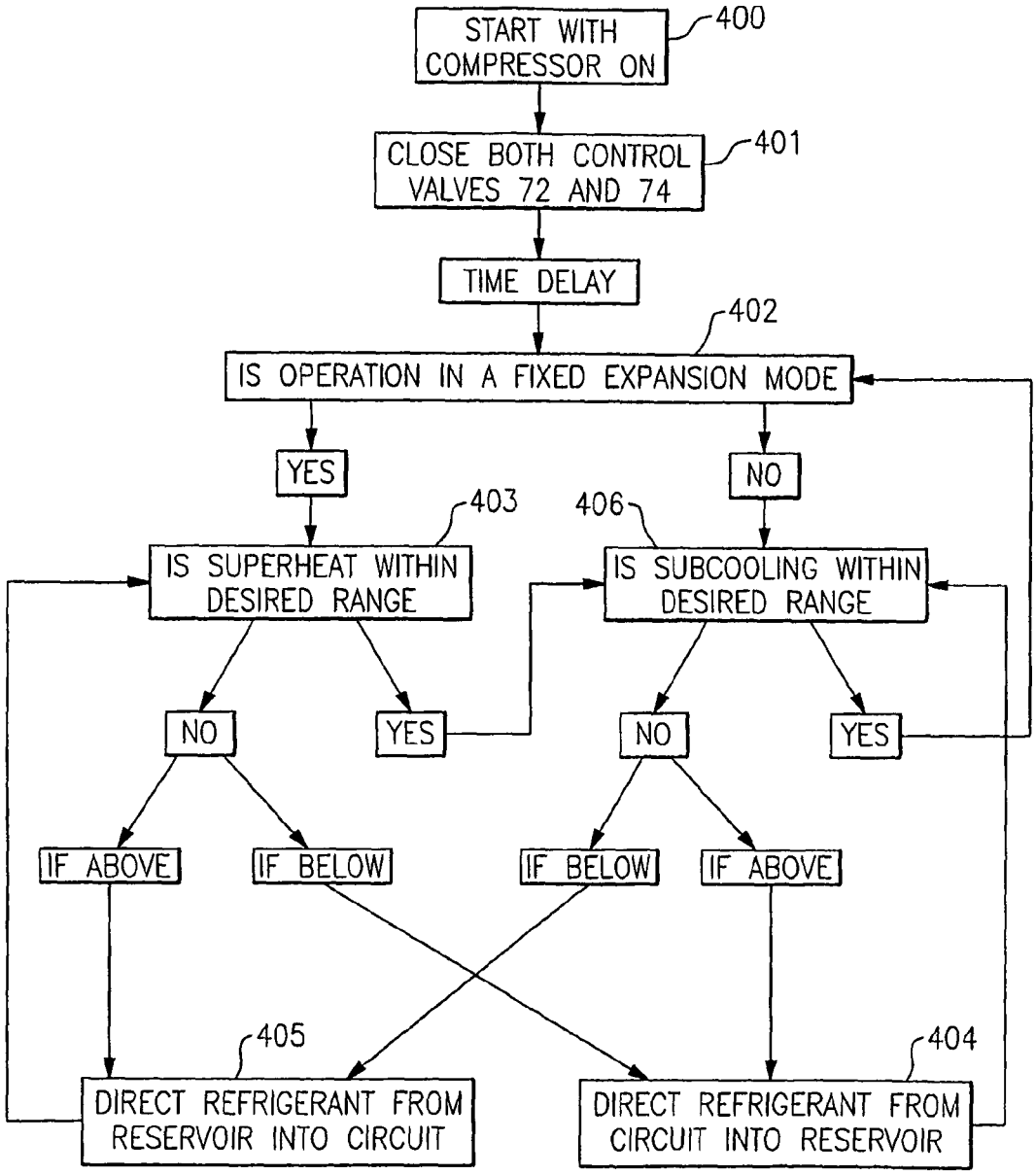
FIG. 16 is a block diagram illustrating a charge control procedure for adjusting refrigerant charge post start-up.

In the charge control procedure, illustrated in FIG. 14, with the refrigerant charge initially set, after ensuring that the compressor 20 is on at block 400, the system controller 100 at block 401 closes both solenoid valves 72 and 74. After a brief time delay, for example about one minute, depending upon the particular mode of current operation, the system controller will at block 403 compare either or both of the degree of superheat or the degree of subcooling currently present in the system to a permissible range of superheat preprogrammed into the controller 100. For example, in the air cooling only and the air cooling with water heating modes, the permissible range of superheat may be from 0.5 to 20 degrees C. and the permissible range of subcooling may be from 2 to 15 degrees C. In the air heating only, the air heating with water heating and the water heating only modes, the permissible range of superheat may be from 0.5 to 11 degrees C. and the permissible range of subcooling may be from 0.5 to 10 degrees C., for example.

After determining at block 402 that the system is operating in a mode with fixed expansion, the system controller, at block 403, compares the current degree of superheat against the permissible range of superheat preprogrammed into the controller 100. If the current degree of superheat is below the permissible range, at block 404, the system controller 100 will modulate the solenoid valve 72 open to drain refrigerant from the refrigerant circuit into the charge tank 70. If the current degree of superheat is above the permissible range, at block 405, the system controller 100 will modulate the solenoid valve 74 open to drain refrigerant from the charge tank 70 into the refrigerant circuit. If the degree of superheat falls within the permissible range of superheat, the system controller proceeds to block 406.

If operating in a mode without fixed expansion, the system controller, at block 407, compares the current degree of subcooling against a permissible range of subcooling programmed into the controller. If the current degree of subcooling is above the permissible range, at block 404, the system controller 100 will modulate the solenoid valve 72 open to drain refrigerant from the refrigerant circuit into the charge tank 70. If the current degree of subcooling is below the permissible range, at block 405, the system controller 100 will modulate the solenoid valve 74 open to drain refrigerant from the charge tank 70 into the refrigerant circuit. If the degree of subcooling falls within the permissible range of subcooling, the system controller proceeds to control refrigerant charge through the charge control procedure and the discharge temperature limit control procedure as described.

The various control parameters presented as examples hereinbefore, such as compressor discharge temperature limit, the various time delays, the desired superheat ranges, the desired subcooling ranges, are for a typical 5 ton capacity, split-system heat pump system having a brazed plate water to refrigerant heat exchanger 60, a refrigerant reservoir (charge tank) 70 having a liquid refrigerant storage capacity of 4 kilograms, a system refrigerant charge of 8 kilograms, and overall refrigerant lines of 7 meters. These parameters are presented for purposes of illustration and those skilled in the art will understand that these parameters may vary from the examples presented for different heat pump configurations and capacities. Those having ordinary skill in the art will select precise parameters to be used in implementing the invention to best suit operation of any particular heat pump system.

While the present invention has been particularly shown and described with reference to the preferred mode as illustrated in the drawing, it will be understood by one skilled in the art that various changes in detail may be effected therein without departing from the spirit and scope of the invention as defined by the claims.

The invention claimed is:

1. A refrigerant circuit heat pump system operable in at least an air cooling mode and an air heating mode and having liquid heating capability comprising:

a refrigerant compressor having a suction port and a discharge port; a selectively positionable reversing valve having a first port, a second port, a third port and a fourth port, said reversing valve being positionable in a first position for coupling the first port and the second port in fluid flow communication and the third port and the fourth port in fluid flow communication, said reversing valve being positionable in a second position for coupling the first port and the third port in fluid flow communication and the second port and the fourth port in fluid flow communication;

a refrigerant circuit providing a closed loop refrigerant circulation flow path, said refrigerant circuit having a first refrigerant line establishing a flow path between the discharge port of said compressor and the first port of said reversing valve, a second refrigerant line establishing a flow path between the second port of said reversing valve and the third port of said reversing valve, and a third refrigerant line establishing a flow path between the fourth port of said reversing valve and the suction port of said compressor;

an outdoor heat exchanger operatively associated with the second refrigerant line and adapted for passing refrigerant through the second refrigerant line in heat exchange relationship with ambient air;

an indoor heat exchanger operatively associated with the second refrigerant line and adapted for passing refrigerant through the second refrigerant line in heat exchange relationship with the air from the comfort zone, said indoor heat exchanger disposed downstream of said outdoor exchanger with respect to refrigerant flow in the air cooling mode and upstream of the outdoor heat exchanger with respect to refrigerant flow through the second refrigerant line in the air heating mode;

a refrigerant to liquid heat exchanger operatively associated with the first refrigerant line and adapted for passing refrigerant through the first refrigerant line in heat exchange relationship with a liquid;

a selectively positionable refrigerant to liquid heat exchanger;

bypass valve operatively associated with the first refrigerant line, said refrigerant to liquid heat exchanger bypass valve having a first position wherein said refrigerant passing through the first refrigerant line from said compressor is directed to the first port of said reversing valve without passing through said refrigerant to liquid heat exchanger and a second position wherein said refrigerant passing through the first refrigerant line from said compressor is directed through said refrigerant to liquid heat exchanger prior to passing to the first port of said reversing valve;

an outdoor heat exchanger bypass valve operatively associated with the second refrigerant line at a location upstream of said outdoor heat exchanger with respect to refrigerant flow when said heat pump system is operating in the air cooling only mode, said outdoor heat exchanger bypass valve having a first position wherein said refrigerant passing through the second refrigerant line from the second port of said reversing valve is directed to pass through said outdoor heat exchanger and a second position wherein said refrigerant passing through the second refrigerant line from the second port of said reversing valve is directed to bypass said outdoor heat exchanger; and an indoor heat exchanger bypass valve operatively associated with the second refrigerant line at a location upstream of said indoor heat exchanger with respect to refrigerant flow when said heat pump system is operating in the air heating only mode, said indoor heat exchanger bypass valve having a first position wherein said refrigerant passing through the second refrigerant line from the third port of said reversing valve is directed to pass through said indoor heat exchanger and a second position wherein said refrigerant passing through the second refrigerant line from the third port of said reversing valve is directed to bypass said indoor heat exchanger.

2. A heat pump system as recited in claim 1 wherein said refrigerant circuit further comprises:

a fourth refrigerant line connecting a port of said outdoor heat exchanger bypass valve with the second refrigerant line at a location intermediate said outdoor heat exchanger and said indoor heat exchanger; and a fifth refrigerant line connecting a port of said indoor heat exchanger bypass valve with the second refrigerant line at a location intermediate said outdoor heat exchanger and said indoor heat exchanger.

3. A heat pump system as recited in claim 2 further comprising:

a controller operatively associated with said reversing valve, said refrigerant to liquid heat exchanger bypass valve, said outdoor heat exchanger bypass valve and said indoor heat exchanger bypass valve, said controller operative to selectively control the respective positioning of said valves between their respective first and second positions so as to selectively configure the refrigerant circuit for operation in one of an air cooling only mode, an air cooling with liquid heating mode, an air heating only mode, an air heating with liquid heating mode, and a liquid heating only mode.

4. A heat pump system as recited in claim 3 further comprising:

a first expansion valve disposed in the second refrigerant line intermediate said outdoor heat exchanger and said indoor heat exchanger; and a second expansion valve disposed in said second refrigerant line intermediate said indoor heat exchanger and said first expansion valve;

said first expansion valve being operatively associated with said indoor heat exchanger and said second expansion valve being operatively associated with said outdoor heat exchanger.

5. A heat pump system as recited in claim 4 further comprising:

a first expansion valve bypass line operatively associated with the second refrigerant line for bypassing refrigerant through said second refrigerant line in a direction from the outdoor heat exchanger to the indoor heat exchanger around said first expansion valve and through said second expansion valve.

6. A heat pump system as recited in claim 4 further comprising:

a second expansion valve bypass line operatively associated with the second refrigerant line for bypassing refrigerant through said second refrigerant line in a direction from the indoor heat exchanger to the outdoor heat exchanger around said second expansion valve and through said first expansion valve.

7. A heat pump system as recited in claim 3 further comprising:

a refrigerant reservoir having an inlet coupled in fluid flow communication to the second refrigerant line at a location intermediate said outdoor heat exchanger and said indoor heat exchanger and having an outlet coupled in fluid flow communication to the third refrigerant line.

8. A heat pump system as recited in claim 7 further comprising:

a first flow control valve operatively associated with said refrigerant reservoir for controlling the flow refrigerant from the second refrigerant line to the inlet of said refrigerant reservoir, said first flow control valve having an open position and a closed position; and a second flow control valve operatively associated With said refrigerant reservoir for controlling the flow of refrigerant between the outlet of said refrigerant reservoir and the third refrigerant line, said second flow control valve having an open position and a closed position;

said first and second flow control valves operatively associated with said controller, said controller being operative to selectively control the respective positioning of said first and second flow control valves between their respective open and closed positions so as to selectively control the refrigerant charge within the refrigerant circuit.

9. A refrigerant circuit heat pump system selectively operable in each of an air cooling only mode, an air heating only mode, a liquid heating only mode, a combined air cooling and liquid heating mode, and a combined air heating and liquid heating mode, comprising:

a refrigerant compressor having a suction port and a discharge port;

a selectively positionable reversing valve having a first port, a second port, a third port and a fourth port, said reversing valve being positionable in a first position for coupling the first port and the second port in fluid flow communication and the third port and the fourth port in fluid flow communication, said reversing valve being positionable in a second position for coupling the first port and the third port in fluid flow communication and the second port and the fourth port in fluid flow communication;

a refrigerant circuit providing a closed loop refrigerant circulation flow path, said refrigerant circuit having a first refrigerant line establishing a flow path between the discharge port of said compressor and the first port of said reversing valve, a second refrigerant line establishing a flow path between the second port of said reversing valve and the third port of said reversing valve, and a third refrigerant line establishing a flow path between the fourth port of said reversing valve and the suction port of said compressor;

an outdoor heat exchanger operatively associated with the second refrigerant line and adapted for passing refrigerant through the second refrigerant line in heat exchange relationship with ambient air;

an indoor heat exchanger operatively associated with the second refrigerant line and adapted for passing refrigerant through the second refrigerant line in heat exchange relationship with the air from a comfort zone, said indoor heat exchanger disposed downstream of said outdoor exchanger with respect to refrigerant flow in the air cooling only mode and upstream of the outdoor heat exchanger with respect to refrigerant flow through the second refrigerant line in the air heating only mode;

a refrigerant to liquid heat exchanger operatively associated with the first refrigerant line and adapted for passing refrigerant through the first refrigerant line in heat exchange relationship with a liquid;

a selectively positionable refrigerant to liquid heat exchanger bypass valve operatively associated with the first refrigerant line, said refrigerant to liquid heat exchanger bypass valve having a first position wherein said refrigerant passing through the first refrigerant line from said compressor is directed to the first port of said reversing valve without passing through said refrigerant to liquid heat exchanger and a second position wherein said refrigerant passing through the first refrigerant line from said compressor is directed through said refrigerant to liquid heat exchanger prior to passing to the first port of said reversing valve;

an outdoor heat exchanger bypass valve operatively associated with the second refrigerant line at a location upstream of said outdoor heat exchanger with respect to refrigerant flow when said heat pump system is operating in the air cooling only mode, said outdoor heat exchanger bypass valve having a first position wherein said refrigerant passing through the second refrigerant line from the second port of said reversing valve is directed to pass through said outdoor heat exchanger and a second position wherein said refrigerant passing through the second refrigerant line from the second port of said reversing valve is directed to bypass said outdoor heat exchanger;

an indoor heat exchanger bypass valve operatively associated with the second refrigerant line at a location upstream of said indoor heat exchanger with respect to refrigerant flow when said heat pump system is operating in the air heating only mode, said indoor heat exchanger bypass valve having a first position wherein said refrigerant passing through the second refrigerant line from the third port of said reversing valve is directed to pass through said indoor heat exchanger and a second position wherein said refrigerant passing through the second refrigerant line from the third port of said reversing valve is directed to bypass said indoor heat exchanger; and a suction line bypass circuit for directing refrigerant flow from said indoor heat exchanger bypass valve to said indoor heat exchanger when said heat pump system is operating in the combined air heating and liquid heating mode.

10. A heat pump system as recited in claim 9 wherein said suction line bypass circuit comprises:

a suction line bypass valve operatively associated with the third refrigerant line at a location intermediate said indoor heat exchanger bypass valve and said indoor heat exchanger and having a first port, a second port, a third port and a fourth port, said suction line bypass valve being selectively positionable in a first position for coupling the first port and the second port in refrigerant flow communication and the third port and the fourth port in refrigerant flow communication, said suction bypass valve being selectively positionable in a second position for coupling the first port and the third port in refrigerant flow communication and the second port and the fourth port in refrigerant flow communication, the first port being connected in refrigerant flow communication with said indoor heat exchanger via the second refrigerant line, and the second port being connected in refrigerant flow communication with the indoor heat exchanger bypass valve;

a suction line bypass line connecting the fourth port of said suction line bypass valve in refrigerant flow communication with said indoor heat exchanger, the suction line bypass line being in parallel refrigerant flow relationship with at least a portion of the second refrigerant line connecting the first port of said suction line bypass valve in refrigerant flow communication with said indoor heat exchanger.

* * * * *